US006584295B2

(12) United States Patent
Omata et al.

(10) Patent No.: US 6,584,295 B2
(45) Date of Patent: Jun. 24, 2003

(54) METHOD AND APPARATUS FOR FORMING AN IMAGE IN A DUPLEX PRINT MODE

(75) Inventors: Yasukuni Omata, Kanagawa (JP); Hideaki Mochimaru, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/012,327

(22) Filed: Dec. 12, 2001

(65) Prior Publication Data

US 2002/0090236 A1 Jul. 11, 2002

(30) Foreign Application Priority Data

Dec. 13, 2000 (JP) ..... 2000-378780
Nov. 15, 2001 (JP) ..... 2001-350341

(51) Int. Cl.[7] ..... G03G 15/16
(52) U.S. Cl. ..... 399/306; 399/66; 399/309
(58) Field of Search ..... 399/309, 306, 399/66, 297, 313, 303, 162, 167, 301

(56) References Cited

U.S. PATENT DOCUMENTS

| | | | | |
|---|---|---|---|---|
| 3,724,944 | A | 4/1973 | Sugita et al. | 355/18 |
| 3,765,760 | A | 10/1973 | Mochimaru | 355/58 |
| 3,884,576 | A | 5/1975 | Mochimaru et al. | 355/69 |

(List continued on next page.)

U.S. PATENT DOCUMENTS

| | | | | |
|---|---|---|---|---|
| 3,901,586 | A | 8/1975 | Suzuki et al. | 359/726 |
| 4,056,320 | A | 11/1977 | Mochimaru et al. | 355/75 |
| 4,105,326 | A | 8/1978 | Mochimaru | 355/55 |
| 4,535,982 | A | 8/1985 | Mochimaru | 271/127 |
| 4,605,299 | A | 8/1986 | Mochimaru | 399/111 |
| 4,688,925 | A | 8/1987 | Randall | 399/309 |
| 4,703,334 | A | 10/1987 | Mochimaru et al. | 347/130 |
| 4,753,543 | A | 6/1988 | Mochimaru et al. | 400/703 |
| 4,757,344 | A | 7/1988 | Idenawa et al. | 399/113 |
| 4,875,063 | A | 10/1989 | Idenawa et al. | 347/152 |
| 4,987,446 | A | 1/1991 | Mochimaru et al. | 399/113 |
| 5,089,855 | A | 2/1992 | Mochimaru et al. | 399/297 |

(List continued on next page.)

FOREIGN PATENT DOCUMENTS

| | | |
|---|---|---|
| EP | 0 657 790 | 6/1995 |
| JP | 6-27757 | 2/1994 |
| JP | 10-104963 | 4/1998 |

OTHER PUBLICATIONS

Patent Abstracts of Japan, JP 10–097144, Apr. 14, 1998.

Patent Abstracts of Japan, JP 9–208076, Aug. 12, 1997.

R. A. Andrews, Xerox Disclosure Journal, vol. 9, No. 1, XP–002067652, pps. 47–48, "Single Pass Duplex in Electronic Systems", Jan./Feb. 1984.

*Primary Examiner*—Sophia S. Chen
(74) *Attorney, Agent, or Firm*—Oblon, Spivak, McClelland, Maier & Neustadt, P.C.

(57) ABSTRACT

An image forming apparatus of the present invention is operable in a duplex print mode for printing images on both sides of a recording medium. A toner image is transferred from a first image carrier to a second image carrier and then transferred from the second image carrier to one side of the recording medium. Subsequently, a toner image is transferred from the first image carrier to the other side of the recording medium. After the toner image has been transferred from the first image carrier to the second image carrier, the second image carrier is moved in the reverse direction to a preselected position. The apparatus of the present invention enhances productivity in the duplex print mode.

66 Claims, 17 Drawing Sheets

U.S. PATENT DOCUMENTS 5,204,716 A * 4/1993 Kasahara et al. ..... 399/309 X
5,394,231 A 2/1995 Sudo et al. ..... 399/228
5,453,822 A * 9/1995 Anzai et al. ..... 399/306 X
5,499,078 A 3/1996 Kurokawa et al. ..... 399/31
5,559,590 A 9/1996 Arai et al. ..... 399/314
5,570,162 A 10/1996 Sohmiya ..... 399/174
5,594,540 A 1/1997 Higaya et al. ..... 399/326
5,615,872 A 4/1997 Mochimaru ..... 271/3.14
5,619,311 A 4/1997 Kurokawa et al. ..... 399/176
5,678,152 A 10/1997 Kohno et al. ..... 399/324
5,758,204 A 5/1998 Haneda et al. ..... 399/66
5,832,354 A 11/1998 Kouno et al. ..... 399/330
5,915,147 A 6/1999 Kouno et al. ..... 399/69
6,038,410 A 3/2000 Iriyama ..... 399/51
6,125,994 A * 10/2000 Todome ..... 399/303 X
6,151,057 A 11/2000 Yamazaki et al. ..... 347/248
6,173,148 B1 1/2001 Matsuda et al. ..... 399/310
6,347,214 B1 2/2002 Kaneko ..... 399/397

* cited by examiner

METHOD AND APPARATUS FOR FORMING AN IMAGE IN A DUPLEX PRINT MODE

BACKGROUND OF THE INVENTION

1. Field of the Invention

The present invention relates to an image forming method and an image forming apparatus capable of forming images on both sides of a sheet or recording medium.

2. Description of the Background Art

A copier, printer, facsimile apparatus or similar image forming apparatus of the type operable in a duplex print mode, i.e., capable of forming images on both sides of a sheet is conventional. It is a common practice with this type of apparatus to transfer a toner image from an image carrier to one side of a sheet, fix the toner image, reverse the sheet via a reverse path, and again feed the sheet for forming a toner image on the other side of the sheet. This kind of scheme, however, lacks reliability in sheet conveyance because a sheet is curled due to the switching of a path and the fixation of a toner image carried on one side of the sheet.

Japanese Patent Laid-Open Publication No. 1-209470, for example, discloses an image forming apparatus constructed to transfer toner images to both sides of a sheet by use of a first and a second image carrier and then fix the toner images at the same time. More specifically, first image transferring means transfers a first toner image from a photoconductive element to an image transfer belt and then transfers a second toner image from the photoconductive element to one side of a sheet. Subsequently, second image transferring means transfers the first toner image from the image transfer belt to the other side of the sheet. The sheet carrying the toner images on both sides thereof is conveyed to a fixing device.

However, the problem with the apparatus taught in the above document is that the image transfer belt must make two turns to print the toner images on both sides of the sheet. More specifically, the second toner image begins to be formed only after the image transfer belt has completed one turn, resulting in low productivity in the duplex print mode.

Technologies relating to the present invention are also disclosed in, e.g., Japanese Patent Laid-Open Publication Nos. 6-27757 and 10-104963.

SUMMARY OF THE INVENTION

It is an object of the present invention to provide an image forming method and an image forming apparatus capable of executing the duplex print mode without lowering productivity.

In accordance with the present invention, an image forming apparatus is operable in a duplex print mode for printing images on both sides of a recording medium. A toner image is transferred from a first image carrier to a second image carrier and then transferred from the second image carrier to one side of the recording medium. Subsequently, a toner image is transferred from the first image carrier to the other side of the recording medium. After the toner image has been transferred from the first image carrier to the second image carrier, the second image carrier is moved in the reverse direction to a preselected position.

Also, in accordance with the present invention, an image forming method transfers, in a duplex print mode, a toner image from a first image carrier to a second image carrier and then transfers the toner image from the second image carrier to one side of a recording medium. The method then transfers a toner image from the first image carrier to the other side of the recording medium to thereby print images on both sides of the recording medium. After the toner image has been transferred from the first image carrier to the second image carrier, the second image carrier is moved in the reverse direction to a preselected position.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
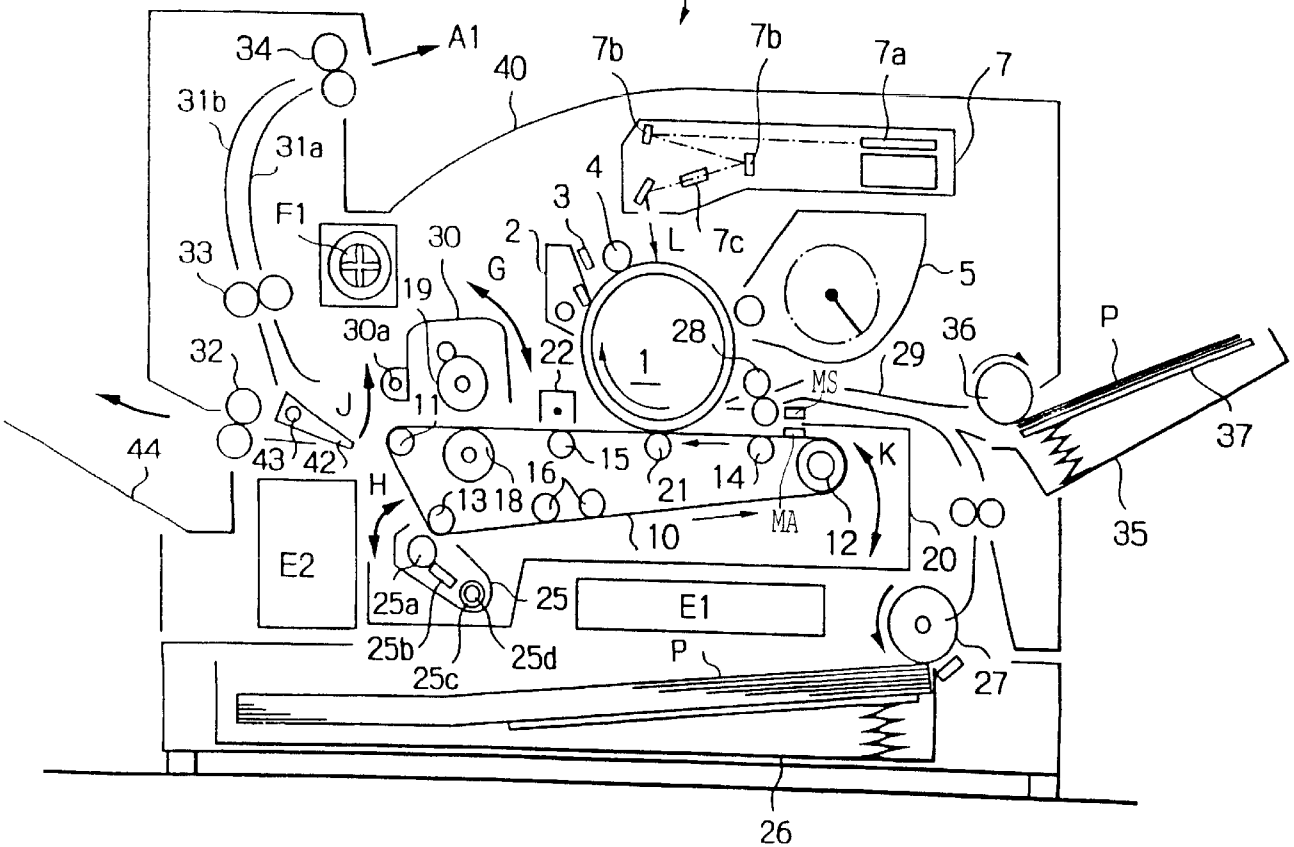
FIG. 1 is a view showing the general construction of an image forming apparatus to which the present invention is applied.

Referring to FIG. 1 of the drawings, the general construction of an image forming apparatus to which the present invention is applied is shown and implemented as a printer by way of example. As shown, the printer, generally 100, includes a photoconductive element or first image carrier 1 positioned at substantially the center. Arranged around the drum 1 are a drum cleaner 2, a discharger 3, a charger 4, and a developing device 5. An optical scanning unit 7 is positioned above the drum 1 and includes a semiconductor laser or light source not shown. A laser beam L issuing from the scanning unit 7 scans the surface of the drum 1 at a position between the charger 4 and the developing unit 5.

A belt unit 20 is positioned below the drum 1 and includes an intermediate image transfer belt or second image carrier (simply belt hereinafter) 10. The belt 10 is passed over rollers 11, 12 and 13 and angularly movable about the roller or drive roller 11 in a direction indicated by a double-headed arrow K into and out of contact with the drum 1. When image formation is not effected, the belt 10 is released from the drum 1 so as to free sheets from curling and to protect the drum 1 from adverse influence. The belt 10 should preferably be released from the drum 1 at the time of jam processing as well.

Figure 18:
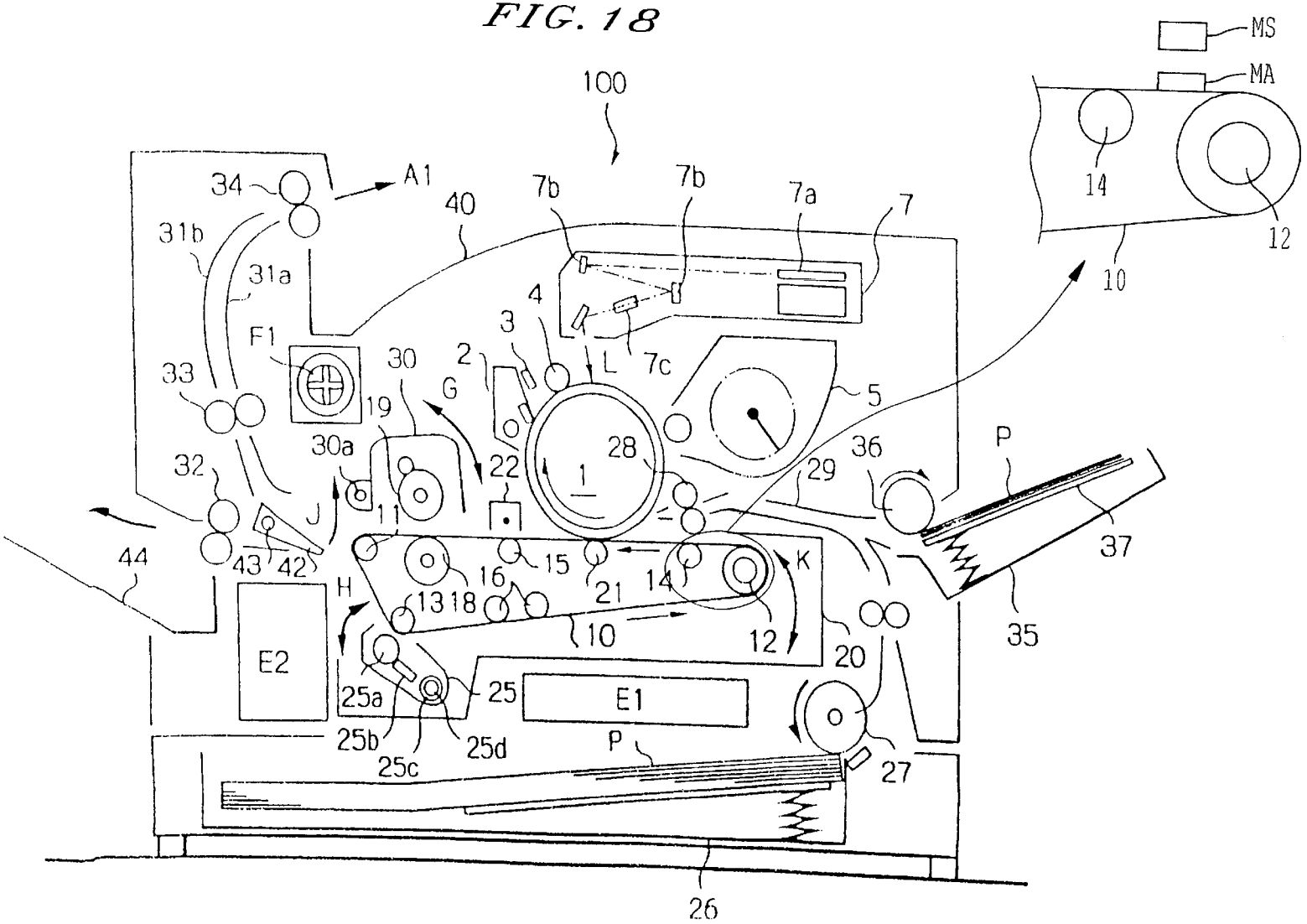
FIG. 18 is a view showing a mark and a mark sensing device for the above embodiments.

The belt 10 is heat-resistant and coated with PFA (perfluoroalkoxy). The belt 10 has resistance of $10^5$ Ω·cm to $10^{12}$ Ω·cm that allows toner to be transferred thereto. A mark MA is provided on the belt 10 as shown in FIG. 18. When the printer is switched on, the mark is optically sensed in order to locate the belt 10 at a preselected position.

Backup rollers 14 and 15, cooling means 16, a heat roller 18 and first image transferring means 21 are arranged between the upper and lower runs of the belt 10. The heat roller 18 accommodates a heater or similar heat source therein for fixing a toner image transferred to a sheet. The first transferring means 21 faces the drum 1 with the intermediary of the belt 10 and transfers the toner image from the drum 1 to either one of the belt 10 and sheet. A stepping motor 53, which is different from a motor assigned to the drum 1, drives the belt 10 via the drive roller 11.

Second image transferring means 22, a fixing device 30 and a belt cleaner 25 adjoin the outer surface of the belt 10. The fixing device 30 includes a heat roller 19 accommodating a heater or similar heat source therein and fixes a toner image formed on a sheet. The fixing device 30 is angularly movable about a fulcrum 30*a* in a direction indicated by a double-headed arrow G. A mechanism, not shown, selectively moves the fixing device 30 into or out of contact with the heat roller 18 with the intermediary of the belt 10 (and sheet) in the direction G.

The belt cleaner 25 includes a roller 25*a*, a blade 25*b* and toner conveying means 25*c* and scrapes off needless toner left on the belt 10. The toner conveying means 25*c* conveys the toner collected in the belt cleaner 25 to a waste toner container not shown. The belt cleaner 25 is angularly movable about a fulcrum 25*d* in a direction indicated by a double-headed arrow H. A mechanism, not shown, selectively moves the belt cleaner 25 into or out of contact with the belt 10 in the direction H.

The drum 1, drum cleaner 2, discharger 3, charger 4 and developing device 5 may be constructed into a unit or process cartridge that can be replaced when the life of any one of the components ends.

A sheet cassette 26 is positioned on the bottom of the printer body and can be bodily pulled out toward the front of the printer body, i.e., in the direction perpendicular to the sheet surface of FIG. 1. The sheet cassette 26 is loaded with a stack of sheets P. A pickup roller 27 is so positioned as to pay out the sheets P one by one from the sheet cassette 26.

A manual feed tray 35 is mounted on one side (right side in FIG. 1) of the printer body. The manual feed tray 35 allows the operator of the printer to feed thick sheets, OHP (OverHead Projector) sheets or similar special sheets P by hand. The manual feed tray 35 includes a bottom plate 37 constantly biased toward a pickup roller 36 together with the sheets P. A registration roller pair 28 is positioned at the right-hand side of the drum 1, as viewed in FIG. 1. A sheet guide 29 guides the sheet P fed from the sheet cassette 26 or the manual feed tray 25 toward the registration roller pair 28. An electric unit E1 and a control unit E2 are positioned above the sheet cassette 26.

A path selector 42 is positioned at the left-hand side of the fixing device 30. The path selector 30 is pivotable about a fulcrum 43 for selectively steering the sheet P conveyed by the belt unit 20 toward either one of a stacker portion 40 and a tray 44. The stacker portion 40 and tray 44 are positioned on the top and one side of the printer body, respectively. A solenoid or similar actuator, not shown, drives the path selector 42. More specifically, the path selector 42 steers the sheet P to the stack portion 40 when held in the position shown in FIG. 1 or steers it toward the tray 44 when shifted in a direction indicated by an arrow J.

A roller pair 33 is positioned above the path selector 42 for conveying the sheet P toward an outlet roller pair 34 that adjoins the stacker portion 40. Guides 31*a* and 31*b* are arranged between the roller pair 33 and outlet roller pair 34. Another outlet roller pair 32 is positioned at the left-hand side of the path selector 42 for driving the sheet P out of the printer body to the tray 44.

The operation of the printer will be described hereinafter. A duplex print mode operation will be described first. In the duplex print mode, an image formed on one side of the sheet P first and an image formed on the other side of the same sheet P next will be respectively referred to as a first image and a second image hereinafter. Also, one side and the other surface mentioned above will be referred to as a first side and a second side, respectively.

When the printer 100 is switched on, the belt or second image carrier 10 is brought to a preselected position on the basis of the mark provided thereon. The charger 4 uniformly charges the surface of the drum 1 being rotated. A computer or similar host machine sends image data to the printer 100. In the scanning unit 7, the semiconductor laser scans the charged surface of the drum 1 with the laser beam L in accordance with the image data via a polygonal mirror 7*a*, a mirror 7*b*, and an fθ lens 7*c*. As a result, a latent image is electrostatically formed on the drum 1.

The developing device 5 develops the latent image with toner to thereby produce a corresponding toner image or first toner image. While the belt 10 is moved in synchronism with the drum 1, the first image transferring means 21 transfers the first toner image from the drum 1 to the outer surface of the belt 10. The drum cleaner 2 removes the toner left on the drum 1 after the image transfer. Subsequently, the discharger discharges the cleaned surface of the drum 1 to thereby prepare it for the next image forming cycle.

The belt 10 turns counterclockwise (forward direction), as viewed in FIG. 1, while carrying the first toner image to be transferred to the first side of the sheet P. At this instant, the second image transferring means 22, fixing device 30 and belt cleaner 25 are maintained inoperative so as not to disturb the toner image carried on the belt 10.

After the entire first toner image has been transferred from the drum 1 to the belt 10, the belt 10 is moved clockwise (reverse direction) to the preselected position. The distance of reverse movement of the belt 10 is controlled on the basis of the number of steps of the stepping motor. The belt 10 is moved in the reverse direction at a speed two times as high as a speed assigned to the forward movement. It is to be noted that the belt 10 is released from the drum 1 when moved in the reverse direction. On reaching the home position, the belt 10 is again brought into contact with the drum 1 and moved counterclockwise (forward direction).

A second toner image to be transferred to the second side of the sheet P is formed on the drum 1 in the same manner as the first toner image. The sheet begins to be fed from the sheet cassette 26 or the manual feed tray 35 toward the registration roller pair 28 by the pickup roller 26 or the pickup roller 36.

The first image transferring means 21 transfers the second toner image from the drum 1 to the second side of the sheet P being conveyed via the registration roller pair 28 and a nip between the drum 1 and the belt 10. The registration roller pair 28 drives the sheet P at a preselected timing that sets up a preselected positional relation between the sheet P and the toner image.

During the transfer of the second toner image to the second side of the sheet P, the first side of the sheet P moves together with, i.e., in contact with the first toner image carried on the belt 10. The second image transferring means 22 transfers the first toner image to the first side of the sheet P by being applied with a bias voltage.

The belt 10 conveys the sheet P carrying the first and second toner images thereon to a position where the heat roller 18 and fixing device 30 are positioned. At this instant, the fixing device 30 is bodily moved such that the heat roller 19 thereof is pressed against the heat roller 18 with the intermediary of the belt 10. As a result, the first and second toner images carried on the sheet P are fixed at the same time. Because the toner images are fixed with the sheet P and belt 10 contacting each other, the toner images are prevented from being disturbed.

The sheet P coming out of the fixing station is separated from the belt 10 at the position where the drive roller 11 is located. Subsequently, the path selector 42 steers the sheet P toward the stacker portion 40 or the tray 44.

Assume that the path selector 42 is so positioned as to steer the sheet P toward the stacker portion 40. Then, the sheet P is laid on the stacker portion 40 with its side (page) carrying the second toner image, which has been directly transferred from the drum 1, facing downward. Therefore, prints can be stacked in order of page if an image on the second page is transferred to the belt 10 first, and then an image on the first page is directly transferred from the drum 1 to a sheet. In this sense, the first and second toner images described above are the image on the second page and the image on the first page, respectively. This is also true with images on the third page and successive pages. More specifically, when an image is present on an even page, there are effected a sequence of steps of forming the image on the even page first, transferring it to the belt 10, forming an image on an odd page preceding the even page, and directly transferring it from the drum 1 to the sheet P.

When the path selector 42 steers the sheet P toward the tray 44, the sheet P is laid on the tray 44 with its second side facing upward. Therefore, the images on the first and seconds sides of the sheet P correspond to the first and second pages, respectively. This is also true with images on the third page and successive pages. More specifically, when an image is present on an odd page, there are effected a sequence of steps of forming the image on the odd page first, transferring it to the belt 10, forming an image on an even page following the odd page, and directly transferring it from the drum 1 to the sheet P.

Usually, a mirror image or reverse image is formed on the drum 1 and then directly transferred to the sheet P in the form of a regular image. However, in the case where an image transferred to the belt 10 is transferred to the sheet P, a mirror image formed on the drum 1 would also be a mirror image on the sheet P. In light of this, in accordance with the present invention, an image to be transferred to the sheet P via the belt 10 is formed on the drum 1 as a regular image while an image to be directly transferred from the drum 1 to the sheet P is formed as a mirror image on the drum 1.

The formation of images in the order of page can be implemented by use of any conventional technology that stores image data in a memory. Also, exposure for selectively forming a regular image or a mirror image can be done with any conventional image processing technology.

After the transfer of the toner image from the belt 10 to the sheet P, the belt cleaner 25 is angularly moved to bring its roller 25*a* into contact with the belt 10. The roller 25*a* removes the toner left on the belt 10 after the image transfer while the blade 25*b* scrapes it off the roller 25*a*. The toner conveying means 25*c* conveys the toner scraped off by the blade 25*b* to the waste toner container not shown.

The cooling means 16 cools off part of the belt moved away from the cleaning station where the belt cleaner 25 is positioned. The cooling means 16 may use any suitable cooling system. For example, when a system using a stream of air is used, it is preferable to feed a stream of air after the transfer of the image to the sheet P so as not to disturb the image. A heat pipe is another possible cooling means and may be held in direct contact with the inner surfaced of the belt 10. In any case, heat absorbed from the belt 10 is discharged to the outside of the printer body. In FIG. 1, a fan F1 is positioned at the left-hand side of the fixing device 30 for releasing heat generated in the printer body to the outside.

A simplex print mode operation also available with the printer 100 will be described hereinafter. First, assume that a simplex print carrying an image on one side thereof is delivered to the stacker portion 40. In this case, a toner image is directly transferred from the drum 1 to the sheet P without the intermediary of the belt 10. In the simplex mode, a mirror image is formed on the drum 1 and then transferred to the sheet P as a regular image.

More specifically, the sheet P is conveyed to the nip between the drum 1 and the belt 10 at the previously stated timing. The first image transferring means 21 transfers a toner image from the drum 1 to the upper surface or first side of the sheet P. The second image transferring means 22 is held inoperative. The belt 10 conveys the sheet P to the fixing station. The sheet or print P coming out of the fixing station is separated from the belt 10 and then delivered toward the stacker portion 40 via the guides 31*a* and 31*b* and outlet roller pair 34, as indicated by an arrow A1 in FIG. 1. As a result, the sheet P is laid on the stacker portion 40 face down, i.e., with the image side of the sheet P facing downward. It follows that a plurality of prints are stacked on the stacker portion 40 in the order of page even when processed from the first page.

Next, assume that a simplex print carrying an image on one side thereof is delivered to the tray 44. In this case, the first image forming means 21 transfers a toner image formed on the drum 1 to the sheet P. After the entire toner image has been transferred from the drum 1 to the belt 10, the belt 10 is moved clockwise (reverse direction) to the preselected position. Again, the distance of reverse movement of the belt 10 is controlled on the basis of the number of steps of the stepping motor. Also, the belt 10 is moved in the reverse direction at a speed two times as high as a speed assigned to the forward movement. It is to be noted that the belt 10 is released from the drum 1 when moved in the reverse direction. On reaching the home position, the belt 10 is again brought into contact with the drum 1 and moved counter-clockwise (forward direction). The sheet P is fed to the nip between the drum 1 and the belt 10 at the previously stated timing, so that the toner image is transferred from the belt 10 to the lower surface of the sheet P. Consequently, a plurality of prints are stacked on the stacker portion 40 in order of page even when processed from the first page.

As stated above, in the simplex print mode, images are formed in the same order both when prints are delivered to the stacker portion 40 and when they are delivered to the tray 44. The difference is that toner images are transferred from the drum 1 to the upper surfaces of sheets when the sheets are delivered to the stacker portion 40 or transferred from the belt 10 to the lower surfaces of the sheet when they are delivered to the tray 44.

Assume that thick sheets, OHP sheets or similar special sheets are fed from the manual feed tray in the simplex print mode. Then, if the tray 44 is selected, the sheets can be conveyed substantially straight and stacked on the tray 44 in order of page.

In the illustrative embodiment, after the transfer of a toner image to the belt 10, the belt 10 is returned to the preselected position, as stated above. Therefore, it is not necessary to wait until the belt 10 completes one turn. This successfully reduces an image forming time. The return of the belt 10 is effective not only in the duplex print mode but also in the simplex print mode. Particularly, by returning the belt 10 at a higher speed than moving it forward (e.g. two times higher speed), it is possible to improve productivity.

Figure 2:
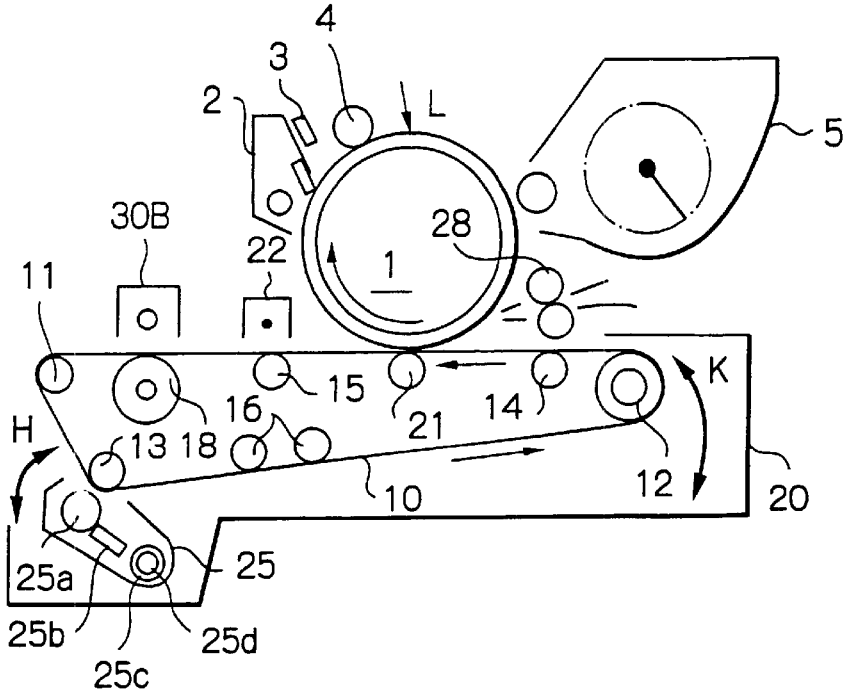
FIG. 2 is a view showing another specific configuration of a fixing device included in the apparatus of FIG. 1.

FIG. 2 shows another specific configuration of the fixing device. As shown, a fixing device 30B does not contact the belt 10 and includes an infrared lamp or a xenon lamp by way of example for fixing a toner image with light. The fixing device 30B is fixed in place and does not have to be moved into and out of contact with the belt 10.

Figure 3:
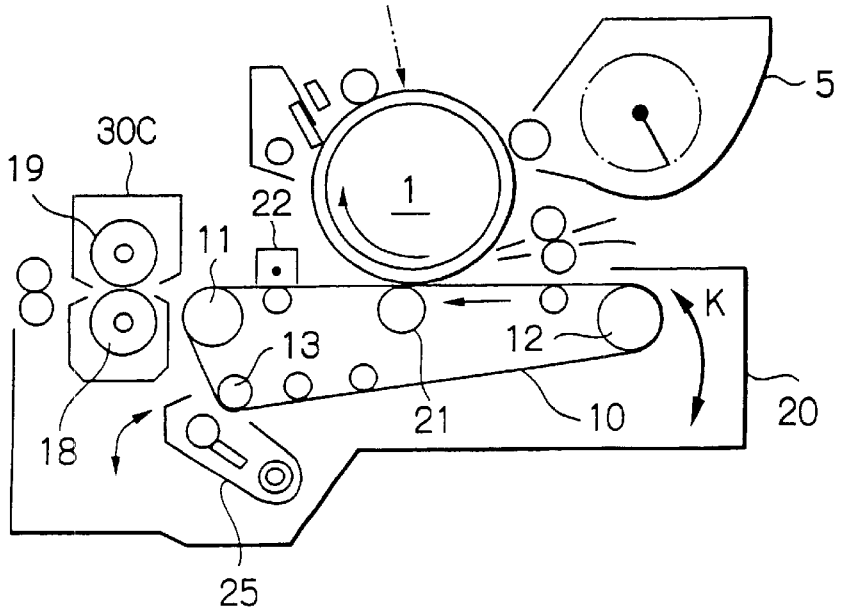
FIG. 3 is a view showing still another specific configuration of the fixing device.

FIG. 3 shows still another specific configuration of the fixing device. As shown, a fixing device 30C includes the heat rollers 18 and 19 each accommodating a heater therein. The fixing device 30C is positioned outside of the loop of the belt 10. The fixing device 30C is also fixed in place and does not have to be moved into and out of contact with the belt 10.

Figure 4:
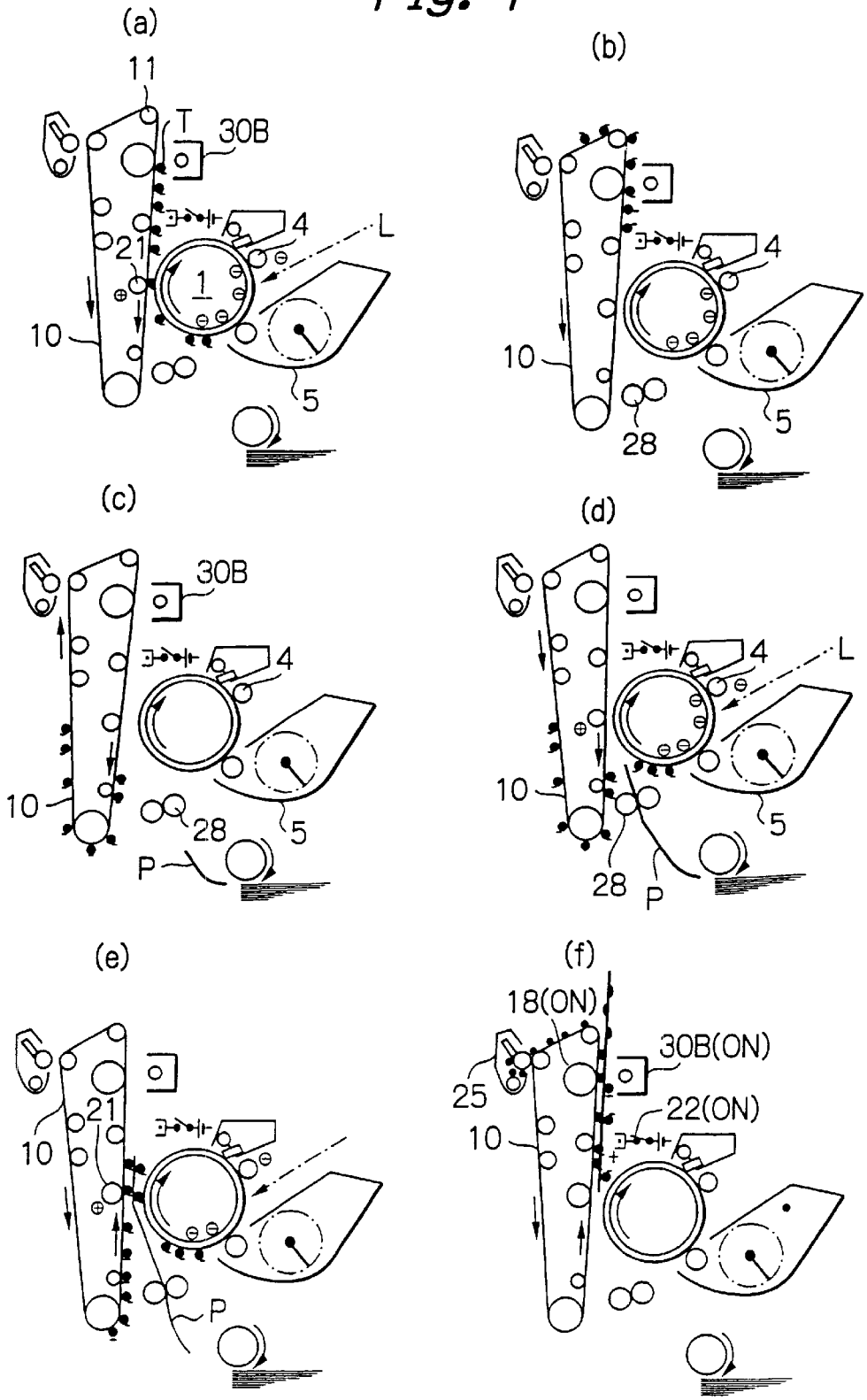
FIG. 4 shows a sequence of image forming steps representative of a first embodiment of the present invention.

Reference will be made to FIG. 4 for describing a specific duplex print procedure representative of a first embodiment of the present invention. In FIG. 4, the belt 10 is shown as extending in the vertical direction due to a limited space available in the figure. The procedure to be described is assumed to use the arrangement shown in FIG. 2. FIG. 4 shows a developing and primary image transferring step (a), a belt stopping step (b), a belt releasing and reversing step (c), a belt forward moving and secondary developing (second surface) step (d), a secondary image transferring step (e), and a tertiary image transferring, fixing and belt cleaning step (f) sequentially executed in this order. While the drum 1 and belt 10 are shown as being spaced from each other for illustration, they are, in practice, held in contact with each other.

Specifically, in the step (a), the charger 4 uniformly charges the surface of the drum 1 to negative polarity. The writing unit scans the charged surface of the drum 1 with the laser beam L to thereby form a latent image. The developing unit 5 deposits negatively charged toner T represented by black dots on the latent image for thereby forming a toner image. The first image transferring means 21 transfers the toner image from the drum 1 to the belt 10.

In the step (b), the belt 10 is caused to stop moving.

In the step (c), the belt 10 is released from the drum 1 and then moved in the reverse direction (clockwise in FIG. 4) to the preselected position. The reverse movement occurs at a speed two times as high as a speed assigned to the forward movement, as stated earlier.

In the step (d), a toner image of negative charge to be transferred to the second side is formed on the drum 1. At the same time, the belt 10 is again brought into contact with the drum 1 and moved forward (counterclockwise in FIG. 4). The registration roller pair 28 conveys a sheet P at the previously mentioned timing.

In the step (e), a positive bias voltage is applied to the first image transferring means 21 with the result that the second toner image is transferred from the drum 1 to the sheet P (secondary image transfer). At this instant, the first side of the sheet P is brought into register with the first image carried on the belt 10.

In the step (f), a positive bias voltage is applied to the second image transferring means 22, so that the first toner image is transferred from the belt 10 to the first side of the sheet P (tertiary image transfer). The belt 10 conveys the sheet P carrying the toner images on opposite sides to the fixing station. At the fixing station, the fixing means 18 and 30B fix the toner images on both sides of the sheet P with heat. The belt cleaner 25 is pressed against the belt 10 for removing the toner left on the belt 10 after the image transfer. When the arrangement shown in FIG. 3 is used, the sheet P will be separated from the belt 10 and then brought to the fixing station.

Another specific duplex print procedure representative of a second embodiment of the present invention will be described hereinafter. In the illustrative embodiment, a charging device or polarity inverting device inverts the polarity of the toner image transferred to the belt or second image carrier 10. Subsequently, a single image transferring means transfers the above toner image and a toner image formed on the drum or first image carrier 1 to opposite sides of the sheet P at the same time. As for the rest of the configuration, the illustrative embodiment is practicable with the configuration shown in FIGS. 1 and 3.

The illustrative embodiment selectively uses two different control systems in dependence on the time when the polarity of the toner image transferred to the second image carrier is inverted, i.e., at the time of reverse movement of the belt 10 or the time of forward movement of the same. First, the system inverting the polarity of the toner image at the time of reverse movement will be described. The illustrative embodiment uses the non-contact type fixing device 30B, FIG. 2.

Figure 5:
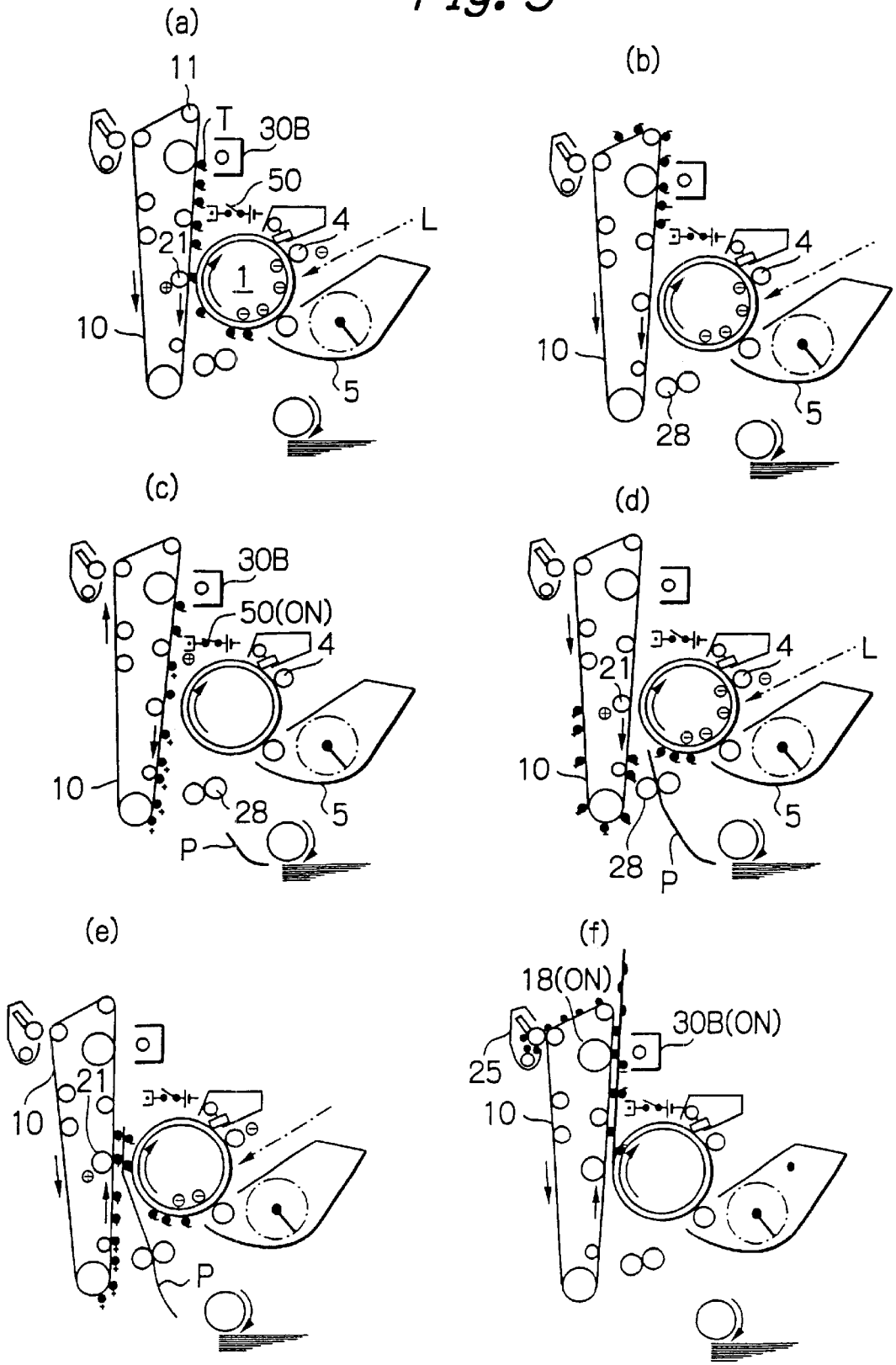
FIG. 5 shows a sequence of image forming steps representative of a second embodiment of the present invention.

As shown in FIG. 5, the illustrative embodiment includes a polarity inverting device 50 positioned downstream of the image transferring means 21 in the direction of forward movement of the belt 10. The belt 10 is angularly movable in the direction K into and out of contact with the drum 1, as stated with reference to FIGS. 1 through 3. The polarity inverting device 50 is also movable in unison with the belt 10, so that the relative position of the device 50 and belt 10 does not change.

The polarity inverting device 50 is configured in the same manner as the second image transferring means 22 and may be implemented by the means 22. The difference is that the relative position between the device 50 and belt 10 does not change, as stated above.

FIG. 5 shows a developing and primary image transferring step (a), a belt stopping step (b), a belt releasing, belt reversing and polarity inverting step (c), a belt forward moving and secondary developing step (second side) (d), a secondary image transferring step (e) and a fixing and belt cleaning step (f) sequentially executed in this order by the illustrative embodiment. The illustrative embodiment does not include the tertiary image transferring step described in relation to the first embodiment. Again, while the drum 1 and belt 10 are shown as being spaced from each other in FIG. 5, they are, in practice, held in contact with each other. Also, the belt 10 is shown as extending in the vertical direction due to a limited space available in the figure.

Specifically, in the step (a), the charger 4 uniformly charges the surface of the drum 1 to negative polarity. The writing unit scans the charged surface of the drum 1 with the laser beam L to thereby form a latent image. The developing unit 5 deposits negatively charged toner T represented by black dots on the latent image for thereby forming a toner image. A positive bias voltage is applied to the first image transferring means 21, 50 that the toner image is transferred from the drum 1 to the belt 10.

In the step (b), as soon as the entire toner image is transferred to the belt 10, the belt 10 is caused to stop moving.

In the step (c), the belt 10 is released from the drum 1 and then moved in the reverse direction (clockwise in FIG. 5) to the preselected position. The reverse movement occurs at a speed two times as high as a speed assigned to the forward movement, as stated earlier. At this instant, a positive bias voltage is applied to the polarity inverting device 50 in order to invert the polarity of the toner image carried on the belt 10 from negative to positive.

In the step (d), a toner image of negative charge to be transferred to the second side is formed on the drum 1. At the same time, the belt 10 is again brought into contact with the drum 1 and moved forward (counterclockwise in FIG. 5). The registration roller pair 28 conveys a sheet P at the previously mentioned timing.

In the step (e), a positive bias voltage is applied to the first image transferring means 21. Consequently, the toner image of positive polarity carried on the belt 1 and the second toner image of negative polarity formed on the drum 1 are transferred to the sheet P at the same time.

In the step (f), the belt 10 conveys the sheet P carrying the toner images on opposite sides to the fixing station. At the fixing station, the fixing means 18 and 30B fix the toner images on both sides of the sheet P with heat. The belt cleaner 25 is pressed against the belt 10 for removing the toner left on the belt 10 after the image transfer. When the arrangement shown in FIG. 3 is used, the sheet P will be separated from the belt 10 and then brought to the fixing station.

Next, the system inverting the polarity of the toner image at the time of forward movement will be described. This system also uses the non-contact type fixing device 30B, FIG. 2. The polarity inverting device is located at the same position as in FIG. 5, but may be fixed in place.

Figure 6:
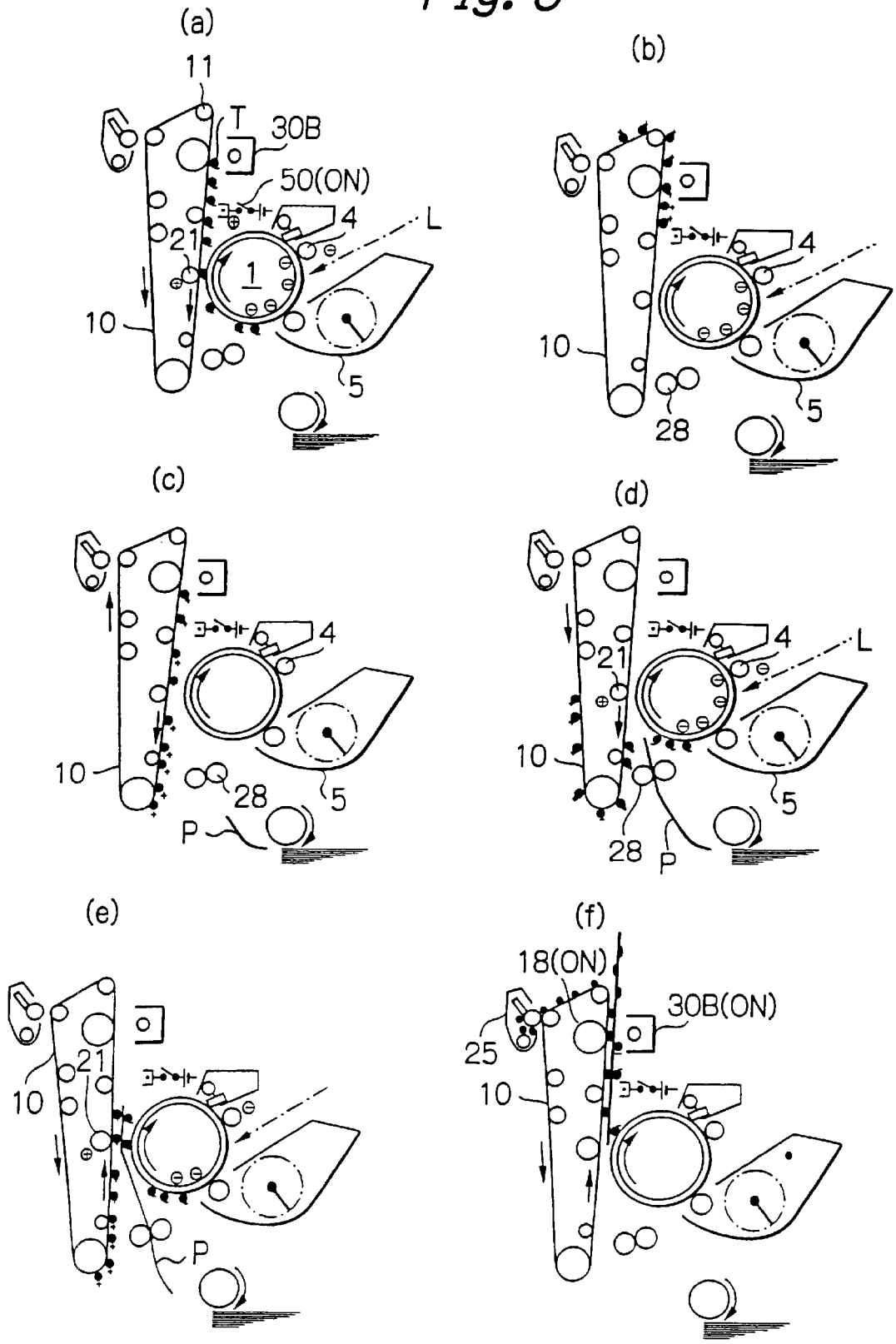
FIG. 6 shows a sequence of image forming steps representative of a modification of the second embodiment.

FIG. 6 shows a developing, primary image transferring and polarity inverting step (a), a belt stopping step (b), a belt releasing and belt reversing step (c), a belt forward moving and secondary developing step (second side) (d), a secondary image transferring step (e) and a fixing and belt cleaning step (f) sequentially executed in this order by the illustrative embodiment. The illustrative embodiment does not include the tertiary image transferring step described in relation to the first embodiment either. Again, while the drum 1 and belt 10 are shown as being spaced from each other in FIG. 5, they are, in practice, held in contact with each other. Also, the belt 10 is shown as extending in the vertical direction due to a limited space available in the figure.

Specifically, in the step (a), the charger 4 uniformly charges the surface of the drum 1 to negative polarity. The writing unit scans the charged surface of the drum 1 with the laser beam L to thereby form a latent image. The developing unit 5 deposits negatively charged toner T represented by black dots on the latent image for thereby forming a toner image. A positive bias voltage is applied to the first image transferring means 21, so that the toner image is transferred from the drum 1 to the belt 10. While the belt 10 conveys the toner image, a positive bias voltage is applied to the polarity inverting device 50 in order to invert the polarity of the toner image from negative to positive.

In the step (b), as soon as the trailing edge of the toner image moves away from the polarity inverting device 50, the belt 10 is caused to stop moving. As a result, the entire toner image carried on the belt 10 is inverted in polarity.

In the step (c), the belt 10 is released from the drum 1 and then moved in the reverse direction (clockwise in FIG. 5) to the preselected position. The reverse movement occurs at a speed two times as high as a speed assigned to the forward movement, as stated earlier. Because the polarity of the toner image on the belt 10 has already been inverted in polarity, the polarity inverting device 50 does not have to be moved in unison with the belt 10.

In the step (d), a toner image of negative charge to be transferred to the second side is formed on the drum 1. At the same time, the belt 10 is again brought into contact with the drum 1 and moved forward (counterclockwise in FIG. 5). The registration roller pair 28 conveys a sheet P at the previously mentioned timing.

In the step (e), a positive bias voltage is applied to the first image transferring means 21. Consequently, the toner image of positive polarity carried on the belt 1 and the second toner image of negative polarity formed on the drum 1 are transferred to the sheet P at the same time.

In the step (f), the belt 10 conveys the sheet P carrying the toner images on opposite sides to the fixing station. At the fixing station, the fixing means 18 and 30B fix the toner images on both sides of the sheet P with heat. The belt cleaner 25 is pressed against the belt 10 for removing the toner left on the belt 10 after the image transfer. When the arrangement shown in FIG. 3 is used, the sheet P will be separated from the belt 10 and then brought to the fixing station.

Assume that the simplex print operation is executed with the system described with reference to FIG. 5 or 6. Then, an image is printed on the sheet P in the same manner as in FIG. 1 with the polarity inverting device 50 being held inoperative. On the other hand, the polarity inverting device 50 is caused to operate when the simplex print operation is effected by way of the belt 10. In this case, the second image is, of course, not formed on the drum 1, developed or transferred, as in FIG. 5 or 6.

In the illustrative embodiment, too, after the transfer of a toner image to the belt 10, the belt 10 is returned to the preselected position, as stated above. Therefore, it is not necessary to wait until the belt 10 completes one turn. This successfully reduces an image forming time. The return of the belt 10 is effective not only in the duplex mode but also in the simplex mode. Particularly, by returning the belt 10 at a higher speed than moving it forward (e.g. two times higher speed), it is possible to improve productivity.

In the embodiments described above, assume that the second toner image to be transferred to the belt 10 has a relatively large image size in the direction of movement of the belt 10. Then, moving the belt 10 in the reversing direction sometimes lowers productivity. For example, when the image size is close to the circumferential length of the belt, it is rather desirable to cause the belt 10 to complete one turn than to reverse it halfway. In light of this, the belt 10 should preferably be selectively reversed or continuously moved forward in accordance with the image size; it is continuously moved forward if the image size is larger than a preselected size.

For example, assume that the maximum image size available with the belt 10 is the A3 profile size that is 420 mm long in the direction of movement of the belt 10. Then, the belt 10 is reversed when the image size is the A4 landscape size (210 mm) or below or caused to complete one forward turn when it is larger than the A4 landscape size. This control is easy to execute with the first embodiment that includes two image transferring means. The control can also be executed with the second embodiment, which inverts polarity and includes a single image transferring means, only polarity is inverted with the belt 10 being moved forward. This successfully prevents productivity from being lowered when the image size is large, and enhances productivity when it is small.

Figure 7A:
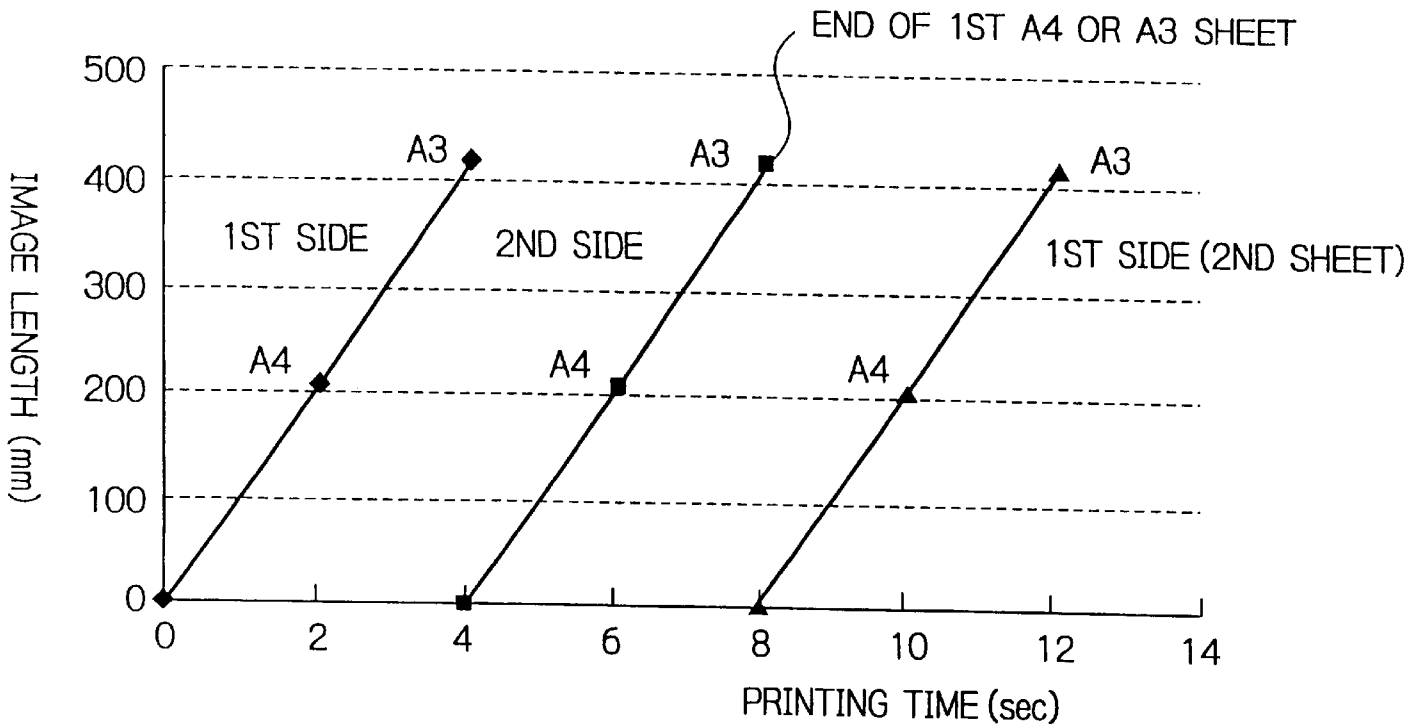
Fig. 7A PRIOR ART
FIG. 7A is a graph showing a relation between an image length and a printing time particular to a conventional image forming apparatus.
Figure 7B:
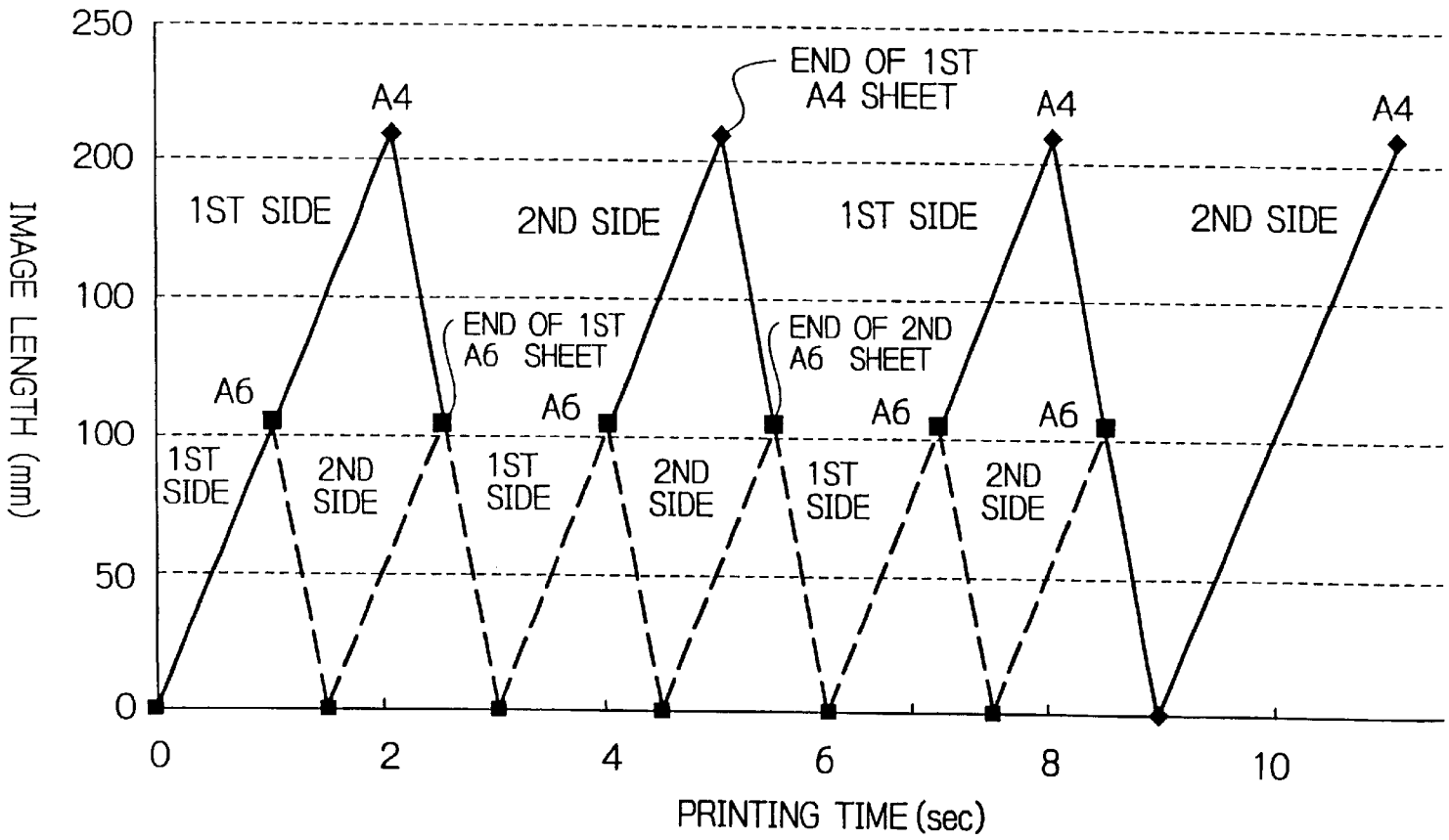
FIG. 7B is a graph showing a relation between an image length and a printing time achievable with the present invention.

FIGS. 7A and 7B compare the present invention that reverses the belt 10 and a conventional printer that does not reverse it with respect to a printing time. In FIGS. 7A and 7B, the maximum image size available with the belt, i.e., the belt size is assumed to be the A3 profile size, and the belt is assumed to move at a speed of 100 mm/sec.

As shown in FIG. 7A, the conventional printer produces a single print by one turn of the belt and has therefore a constant printing time without regard to the sheet size or image size. As FIG. 7A indicates, it takes about 8 seconds for images to be printed on both sides of a sheet of A3 size; it takes 6 seconds even for the second image of A4 size to be transferred to a sheet (4 seconds for one turn of the belt+2 seconds for the second image).

As shown in FIG. 7B, in accordance with the present invention, images of size A4 can be fully formed on both sides of a sheet only in about 5 seconds (2 seconds for first side+1 second for reverse movement+2 seconds for second side). Further, when images of size A6 are formed on both sides of a sheet with the belt 10 being reversed, only about 2.5 seconds suffice (1 second for first side, 0.5 second for reverse movement+1 second for second side). By contrast, it takes 5 seconds for the conventional printer to complete image transfer (4 seconds for one turn+1 second for second side).

As stated above, when the maximum image size available with the belt 10 is the A3 profile size, the embodiments shown and described successfully reduce the printing time when the image size is the A4 landscape size or below.

Figure 8:
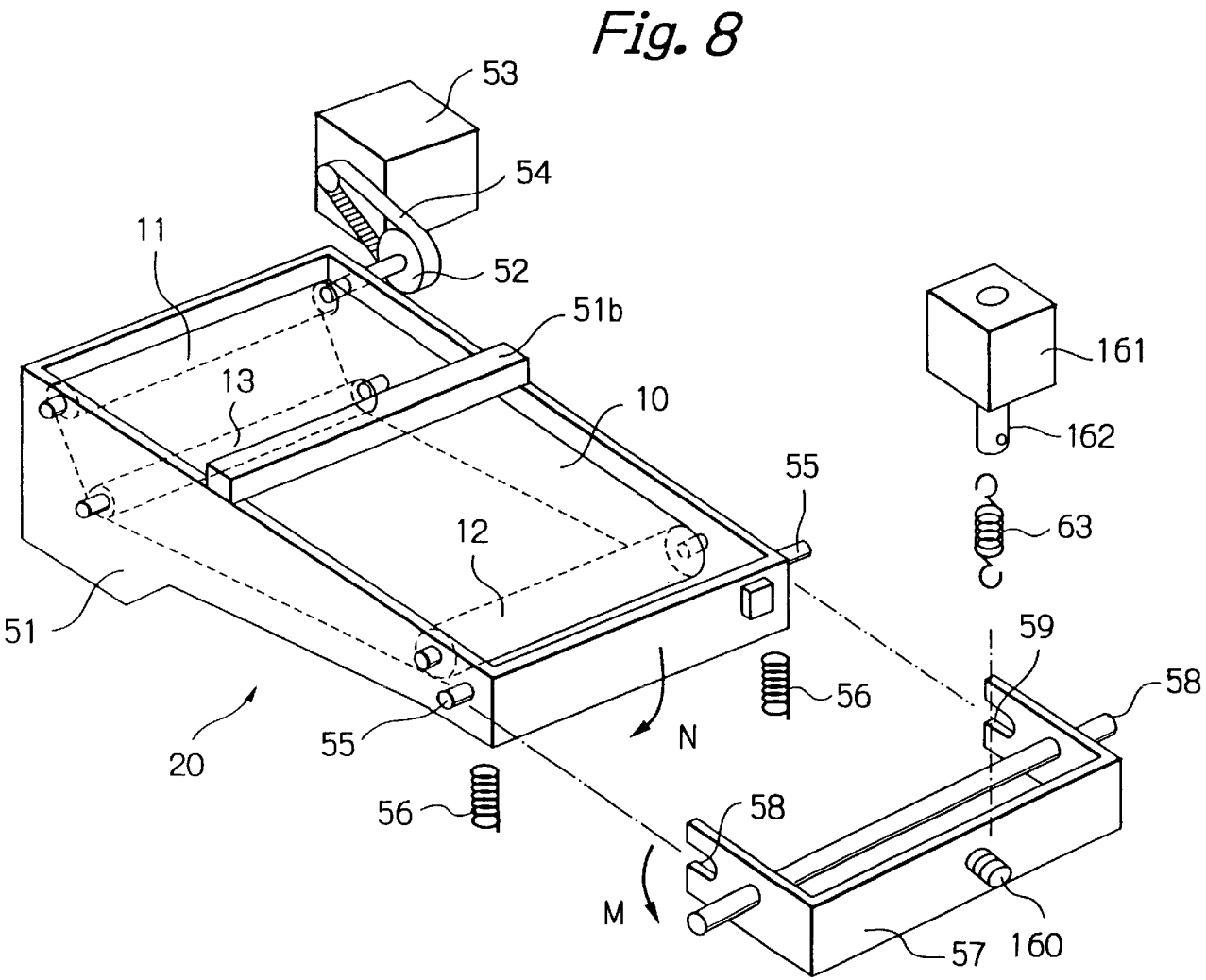
FIG. 8 is a perspective view showing a specific mechanism for moving an intermediate image transfer belt into and out of contact with a photoconductive drum.

Referring to FIG. 8, a specific configuration for moving the belt 10 into and out of contact with the drum 1 will be described. As shown, the belt unit 20 includes a box-line frame 51 supporting the belt 10 thereinside. Specifically, the belt 10 is passed over three rollers 11,12 and 13 journalled to the frame 51. A tie bar 51*b* connects the opposite sides of the frame 51 so as to reinforce the frame 51. The heat roller 18, image transfer roller and others not relevant to the understanding of the specific configuration are not shown in FIG. 8.

A pulley 52 is mounted on one end of the roller 11. A drive belt 54 is passed over the pulley 52 and a pulley mounted on the output shaft of a stepping motor 53. When the stepping motor 53 is driven in the forward or reverse direction, it causes the belt 10 to move forward or reverse, respectively.

The shaft of the roller or drive roller 11 is rotatably supported by a body frame (printer body) not shown. The belt unit 20 is angularly movable about the roller 11. A spring 56 constantly biases the underside of the frame 51 upward in the vicinity of the roller 13, pressing the belt 10 against the drum 1 with a preselected force. A member, not shown, mounted on the frame 51 contacts a support member, not shown, assigned to the drum 1 to thereby maintain a preselected positional relation between the belt 10 and the drum 1.

Bosses 55 protrude from the opposite sides of the frame 51 in the vicinity of the roller 13. A generally U-shaped yoke member 57 is formed with U-shaped notches 58 each receiving one of the bosses 55. A shaft 59 extends throughout the opposite sides of the U-shaped shaped yoke member 57 and is journalled to the body frame. A stub 160 protrudes outward from the bottom of letter U of the yoke member 57. A solenoid 161 is mounted on the body frame above the stub 160. A spring 63 connects the stub 160 and a plunger 162 protruding from the solenoid 161.

In operation, when the solenoid 161 is energized, it pulls its plunger 162 and thereby causes the yoke member 57 to angularly move counterclockwise, as viewed in FIG. 8, as indicated by an arrow M. As a result, the bosses 55 of the frame 51 are pressed downward against the action of the spring 56, causing the belt unit 20 to angularly move clockwise, as viewed in FIG. 8, as indicated by an arrow N. The belt 10 is therefore released from the drum 1. When the solenoid 161 is deenergized, the plunger 162 again protrudes from the solenoid 161 with the result that the belt unit 20 returns to its original position under the action of the spring 56. As a result, the belt 10 is again brought into contact with the drum 1. At this instant, the yoke member 57, of course, returns to its original position.

Figure 9:
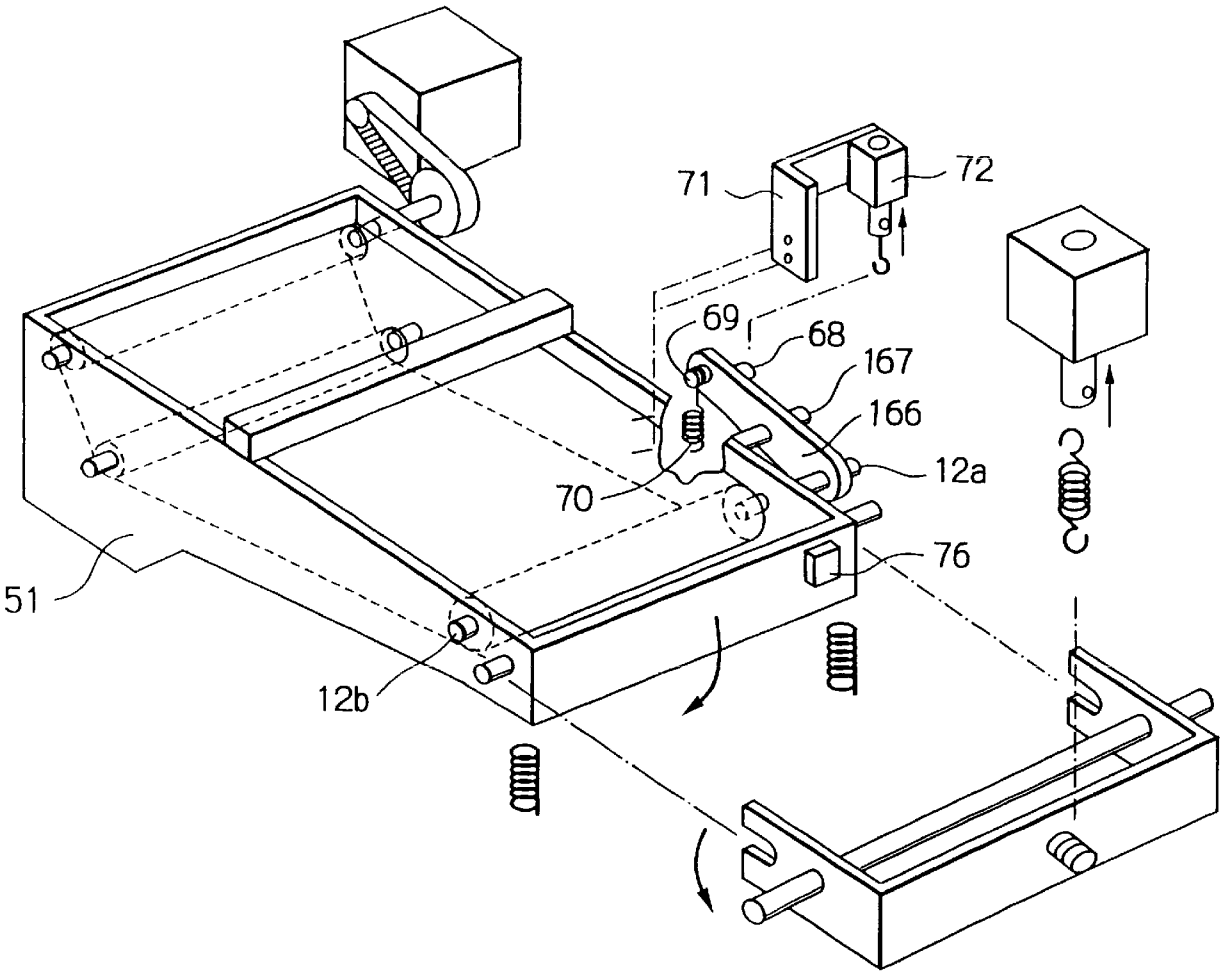
FIG. 9 is an isometric view showing a specific mechanism for preventing the belt from becoming offset.

Reference will be made to FIGS. 9 and 10A through 10C for describing a specific mechanism for preventing the offset of the belt 10. In FIG. 9, structural elements identical with the structural elements shown in FIG. 8 are designated by identical reference numerals.

Figure 10A:
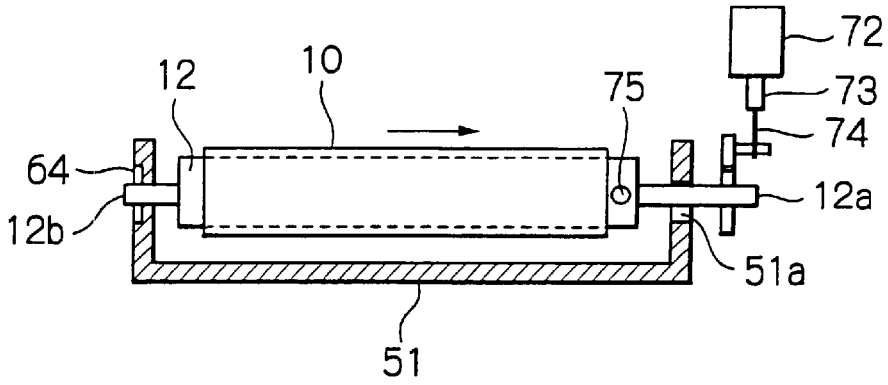
FIGS. 10A through 10C are side elevations demonstrating the operation of the mechanism shown in FIG. 9.
Figure 10B:
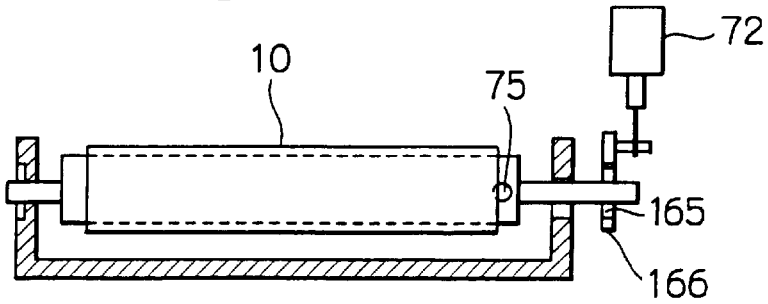
Figure 10C:
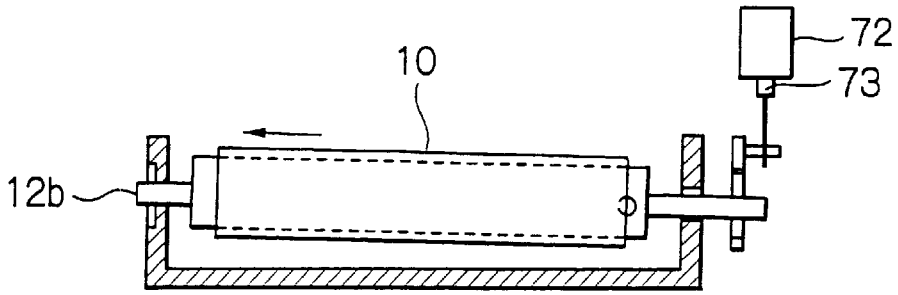

As shown in FIGS. 10A through 10C, the roller 12 is slightly tiltable from its horizontal position. Specifically, a shaft 12*a* protrudes from one end of the roller 12 and is passed through a notch 51*a* formed in one side wall of the frame 51. A shaft 12*b* protruding from the other end of the roller 12 is supported by the other side wall of the frame 51 via a bearing 64. A lever 166 supports the shaft 12*a* via a bearing 165. As shown in FIG. 9, a shaft 167 protruding from the frame 51 rotatably supports the lever 166.

Pins 68 and 69 are studded on the opposite sides of the lever 166 at the end of the lever 166 remote from the roller 12. A tension spring 70 is anchored to the pin 69 and frame 51, constantly biasing the pin 69 downward. The lever 166 therefore tends to rotate counterclockwise, as viewed in FIG. 9. A solenoid 72 is mounted on the frame 51 via a bracket 71. The solenoid 72 has a plunger 73 having a hook 74 fixed to its bottom. The hook 74 hooks the pin 69.

When the solenoid 72 is deenergized, the tension spring 70 pulls the pin 69 of the lever 66 downward while pulling out the plunger 73. As a result, the lever 166 rotates counterclockwise, as viewed in FIG. 9, and lifts the shaft 12*a*, as shown in FIG. 10A. At this time, the roller 12 is slightly tilted from its horizontal position, i.e., raised at the shaft 12*a* side. In this condition, the belt 10 runs while tending to move sideways toward the raised end, i.e., shaft 12*a* side of the roller 12, as indicated by an arrow in FIG. 10A. FIG. 10B shows the belt 10 moved toward the shaft 12*a* sideways.

As shown in FIG. 10C, when the solenoid 72 is energized, the plunger 73 retracts into the solenoid 72 and lifts the pin 68 against the action of the tension spring 70. As a result, the lever 166 rotates clockwise, as viewed in FIG. 9, causing the roller 12 to slightly tilt from its horizontal position; that is, the shaft 12*a* side of the roller 12 is lowered. In this condition, the belt 10 runs while tending to move sideways toward the raised end, i.e., shaft 12*b* side of the roller 12, as indicated by an arrow in FIG. 10C.

In the illustrative embodiment, the end portion of the roller 12 adjoining the shaft 12*a* is provided with a spot 75. A sensor 76 mounted on the inner periphery of the frame 51 emits light toward the spot 75. When the belt 10 is shifted toward the shaft 12*a* sideways, it conceals the spot 75. The resulting output of the sensor 76 shows that the belt 10 is shifted toward the shaft 12*a*. In response, the solenoid 72 is turned on to slightly tilt the roller 17 from the horizontal position, i.e., lowers the shaft 12*a* side of the roller 12, thereby correcting the offset of the belt 10. A spot and a sensor may additionally be provided at the shaft 12*b* side of the roller 12, if desired.

It is to be noted that the offset of the belt 10 can be corrected only if the belt 10 is driven in the reverse direction. This obviates the need for the mechanism described above. More specifically, the belt 10 may be reversed at a preselected timing for a preselected period of time in order to correct an offset.

The present invention may be implemented as a full-color printer capable of forming full-color images on both sides of a sheet P, as will be described hereinafter as a third embodiment. While a full-color duplex print mode is practicable with either one of the systems of the first and second embodiments, let the following description concentrate on the system of the former that does not switch the polarity of a toner image.

Figure 11:
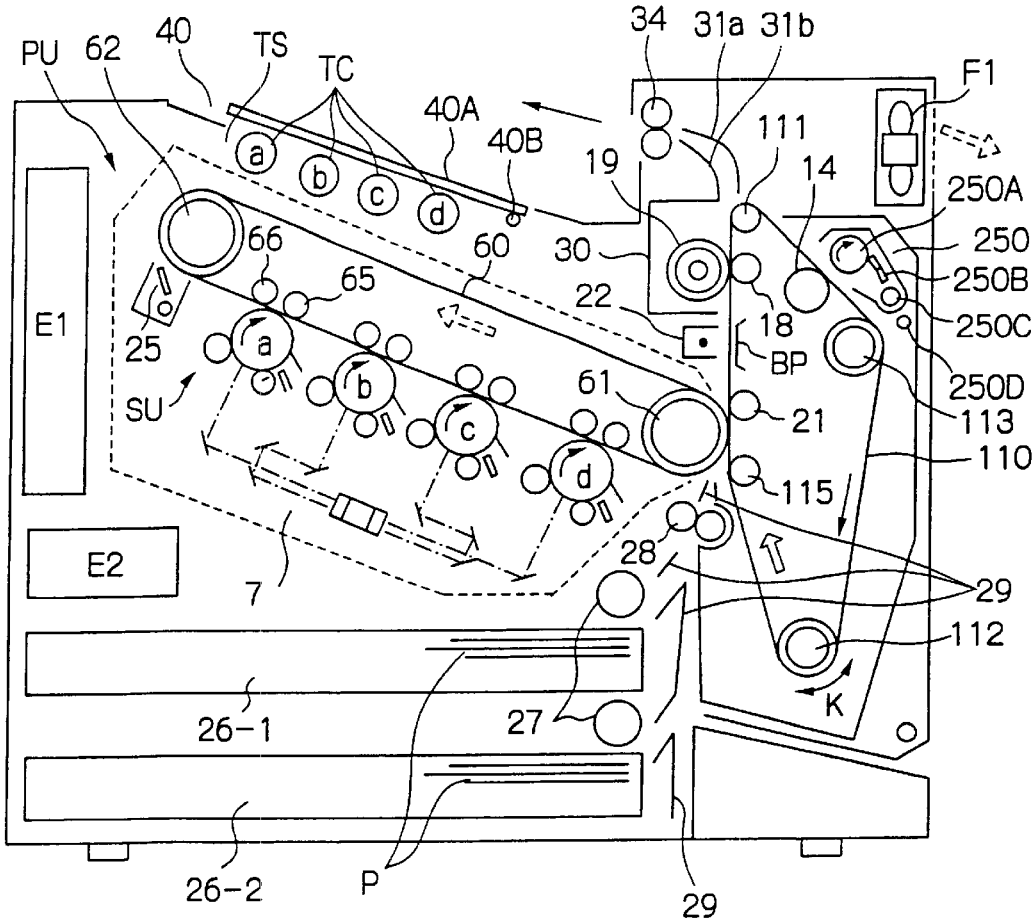
FIG. 11 is a view showing a full-color image forming apparatus representative of a third embodiment of the present invention.

As shown in FIG. 11, the full-color printer includes an image forming section PU located substantially at the center. Four image forming units SU are arranged side by side along the lower run of an inclined, intermediate image transfer belt (simply belt hereinafter) 60 and held in contact with the belt 60. The optical scanning unit 7 is positioned below the image forming units SU. The image forming units SU are identical in configuration except for the color of toner to use. Only one of the image forming units SU will be described hereinafter with reference to FIG. 12.

Figure 12:
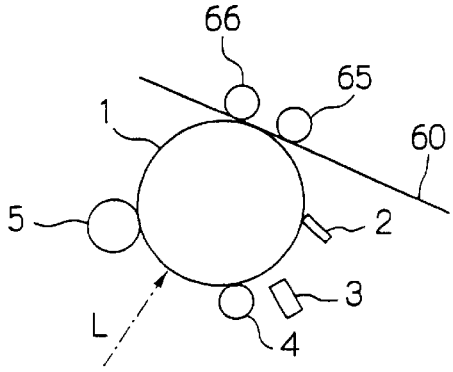
FIG. 12 is a section showing an image forming unit included in the third embodiment.

As shown in FIG. 12, the image forming unit SU includes the drum 1 and the drum cleaner 2, discharger 3, charger 4 and developing device 5 arranged around the drum 1. The developing unit 5 stores one of cyan toner, magenta toner, yellow toner and black toner and deposits in a latent image formed on the drum 1. The scanning unit 7 scans the drum 1 imagewise with the laser beam L at a writing position between the charger 4 and the developing device 5. While the scanning unit 7 uses a semiconductor laser in the illustrative embodiment, it may use the combination of an LED (Light Emitting Diode) array and focusing means. An image transfer roller 65 and a backup roller 66 face the drum 1 with the intermediary of the belt 60. The image transfer roller 65 transfers a toner image from the drum 1 to the belt 60.

Referring again to FIG. 11, the belt 60 is passed over a drive roller 61 and a driven roller 62 and caused to move counterclockwise, as indicated by an arrow. The structural elements positioned between the opposite runs of the belt 60 except for the image transferring means are suitably connected to ground via the printer frame. The belt cleaner 25 adjoins the belt 60 in the vicinity of the driven roller 62. A toner storing section TS is positioned above the belt 60 and includes toner cartridges TC (a through d) each storing fresh toner of a particular color. A powder pump, not shown, replenishes the toner from each of the toner cartridges a through d to corresponding one of the developing devices.

A cyan, a magenta, a yellow and a black toner image formed on the drums 1 of the four image forming units SU are sequentially transferred to the belt 60 one above the other, completing a full-color image. To form a black-and-white image, only the image forming unit SU storing the black toner is operated to form the image on the drum 60. In the illustrative embodiment, the image forming unit SU (d) located at the most downstream side is assumed to store the black toner, so that productivity is not lowered in a black-and-white mode.

Another intermediate image transfer belt or body (simply belt hereinafter) 110 is positioned at the right-hand side of the image forming section PU. The belt 110 is passed over rollers 111, 112, 113 and 115. A stepping motor, not shown, is exclusively assigned to the roller 111, which is a drive roller, and causes the belt 110 to run via the drive roller 111. In the illustrative embodiment, the belt 110 is bodily angularly movable about the drive roller 111 into and out of contact with the belt 60, as indicated by a double-headed arrow K in FIG. 11. A mechanism, not shown, moves the belt 110 in the direction K.

In the illustrative embodiment, the belt 110 is heat-resistance and has resistance that allows toner to be transferred thereto. A mark, not shown, is printed on the surface of the belt 110. When the printer is switched on, the belt 110 is brought to its home position with the mark being optically sensed.

The image transfer roller or first image transferring means 21 is positioned between the opposite runs of the belt 110 and adjoins the roller 61 of the image forming section PU. The heat roller, backup rollers 114 and 115 and a backup plate BP are also positioned between the opposite runs of the belt 110. The roller 112 plays the role of cooling means as the same time. The structural elements within the loop of the belt 110 other than the image transferring means are suitably connected to ground via the body frame.

A belt cleaner 250 and the charger or second image transferring means 22 are positioned outside of the loop of the belt 110. The belt cleaner 250 includes a roller 250A, a blade 250B and toner conveying means 250C and removes needless toner, paper dust and other impurities from the belt 110 after image transfer. The belt cleaner 250 is angularly movable about a fulcrum 250D into and out of contact with the belt 110. More specifically, the belt cleaner 250 is released from the belt 110 before image transfer to a sheet P and when a toner image is present on the belt 110, but brought into contact with the belt 110 at the time of cleaning. In FIG. 11, the belt cleaner 250 is shown in a position spaced from the belt 110.

The image transfer roller 21 and backup roller 115 and the roller 61 supporting the belt 60 cause the belts 60 and 110 to contact each other, forming a nip for image transfer. The charger 22 faces the backup roller BP, which is positioned above the image transfer roller 21, outside of the loop of the belt 110.

Two sheet cassettes 26-1 and 26-2 are positioned one above the other below the image forming section PU. A pickup roller 27 is associated with each of the sheet cassettes 26-1 and 26-2 for paying out the top sheet toward the registration roller pair 28 via the guides 29.

The fixing device 30 faces the heat roller 18 disposed in the loop of the belt 110. A mechanism, not shown, moves the fixing device 30 into and out of contact with the belt 110 in the same manner as in the first embodiment. In FIG. 11, the fixing device 30 is shown in a position in which the heat roller 19 contacts the belt 110.

In the illustrative embodiment, when the printer is switched on, the belt 110 is initialized to its preselected position on the basis of the mark printed thereon. In the duplex print mode, a first image formed by the image forming section PU is first transferred from the belt 60 to the belt 110. Subsequently, a second toner image is formed by the image forming section PU.

More specifically, while the belt 110 is in clockwise rotation (forward direction), the first toner image to be transferred to the first side of a sheet P is transferred from the belt 60 to the belt 110. At this instant, the second image transferring means 22, fixing device 30 and belt cleaner 25 are held inoperable, i.e., deenergized or released from the belt 110.

After the entire toner image has been transferred from the belt 60 to the belt 110, the belt 110 is reversed, i.e., rotated counterclockwise to its preselected position. This is also controlled on the basis of the number of steps of a stepping motor or drive means. The distance of reverse movement of the belt 10 is controlled on the basis of the number of steps of the stepping motor. In the illustrative embodiment, the belt 10 is moved in the reverse direction at a speed two times as high as a speed assigned to the forward movement. It is to be noted that the belt 110 is released from the belt 60 when moved in the reverse direction. On reaching the preselected position, the belt 110 is again brought into contact with the belt 60 and moved clockwise (forward direction).

The image forming section PU forms a second toner image to be transferred to the second side of the sheet P on the belt 60 in the same manner as the first toner image. The top sheet P begins to be fed from the sheet cassette 26-1 or 26-2 toward the registration roller pair 28 by the pickup roller 27.

The image transfer roller or first image transferring means 21 transfers the second toner image from the belt 60 to the second side of the sheet P being conveyed via the registration roller pair 28. The registration roller pair 28 drives the sheet P at a preselected timing. At this instant, the first toner image on the belt 110 has already returned to the preselected position of the belt 110 and is therefore brought into register with the first side of the sheet P. The belt 110 conveys the sheet P carrying the first and second toner images thereon upward. The charger or second image transferring means 22 transfers the first toner image from the belt 110 to the first side of the sheet P. The belt 110 then conveys the sheet P to the fixing station.

At the fixing station, the fixing device 30 is bodily moved such that the heat roller 19 thereof is pressed against the heat roller 18 with the intermediary of the belt 110. As a result, the first and second toner images carried on the sheet P are fixed at the same time. The sheet P coming out of the fixing station is separated from the belt 10 at the position where the drive roller 111 is located. Subsequently, the belt 110 continues its forward movement while the belt cleaner 250 cleans the belt 110.

In the simplex print mode, an image formed by the image forming section PU is directly transferred from the belt 60 to a sheet P without the intermediary of the belt 110. In this case, the belt 110 should only be moved forward in synchronism with the belt 60 without any reverse movement.

As stated above, the illustrative embodiment transfers a toner image formed by the image forming section PU from the belt 60 to either one of the sheet P and belt or intermediate image transfer body 110. In this sense, the belts 60 and 110 correspond to the first image carrier and second image carrier, respectively.

In the illustrative embodiment, too, after the transfer of a toner image to the belt or second image carrier 110, the belt 110 is returned to the preselected position, as stated above. Therefore, it is not necessary to wait until the belt 110 completes one turn. This successfully reduces an image forming time. The return of the belt 110 is effective not only in the duplex mode but also in the simplex mode. Particularly, by returning the belt 110 at a higher speed than moving it forward (e.g. two times higher speed), it is possible to improve productivity.

Figure 13:
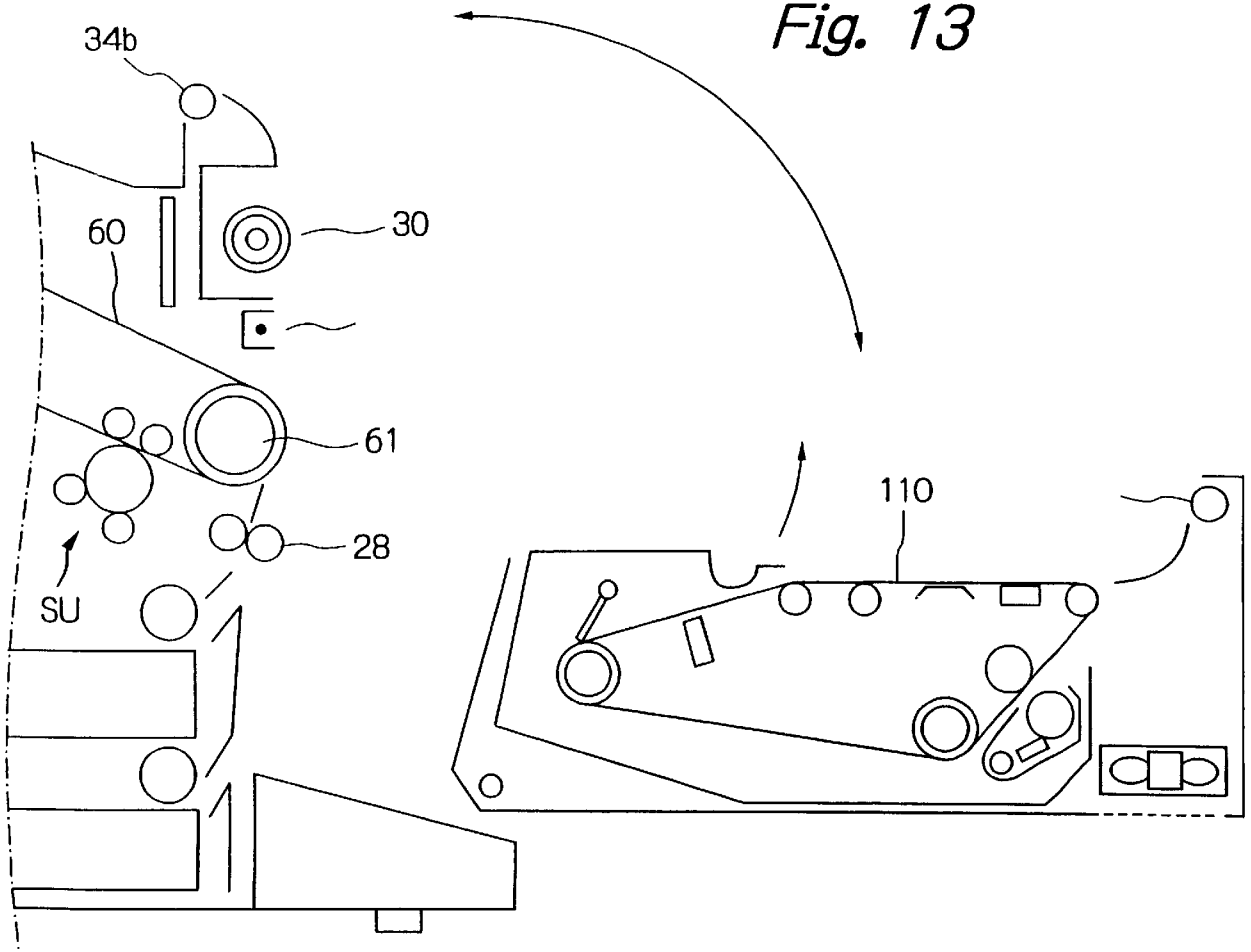
FIG. 13 is a fragmentary section showing the third embodiment with a cover loaded with a second image carrier being held in an open position.

As shown in FIG. 13, the belt 110, structural elements disposed in the loop of the belt 110 and belt cleaner 250 are mounted on a cover openably mounted on the printer body. An upper roller forming part of the outlet roller pair 34 and a lower roller 34*b* forming the other part of the same are mounted on the cover and printer body, respectively. When the cover is opened, it uncovers the sheet path extending from the sheet feed section to the outlet roller pair 34 and promotes easy access at the time of, e.g., removal of a jamming sheet.

Figure 14:
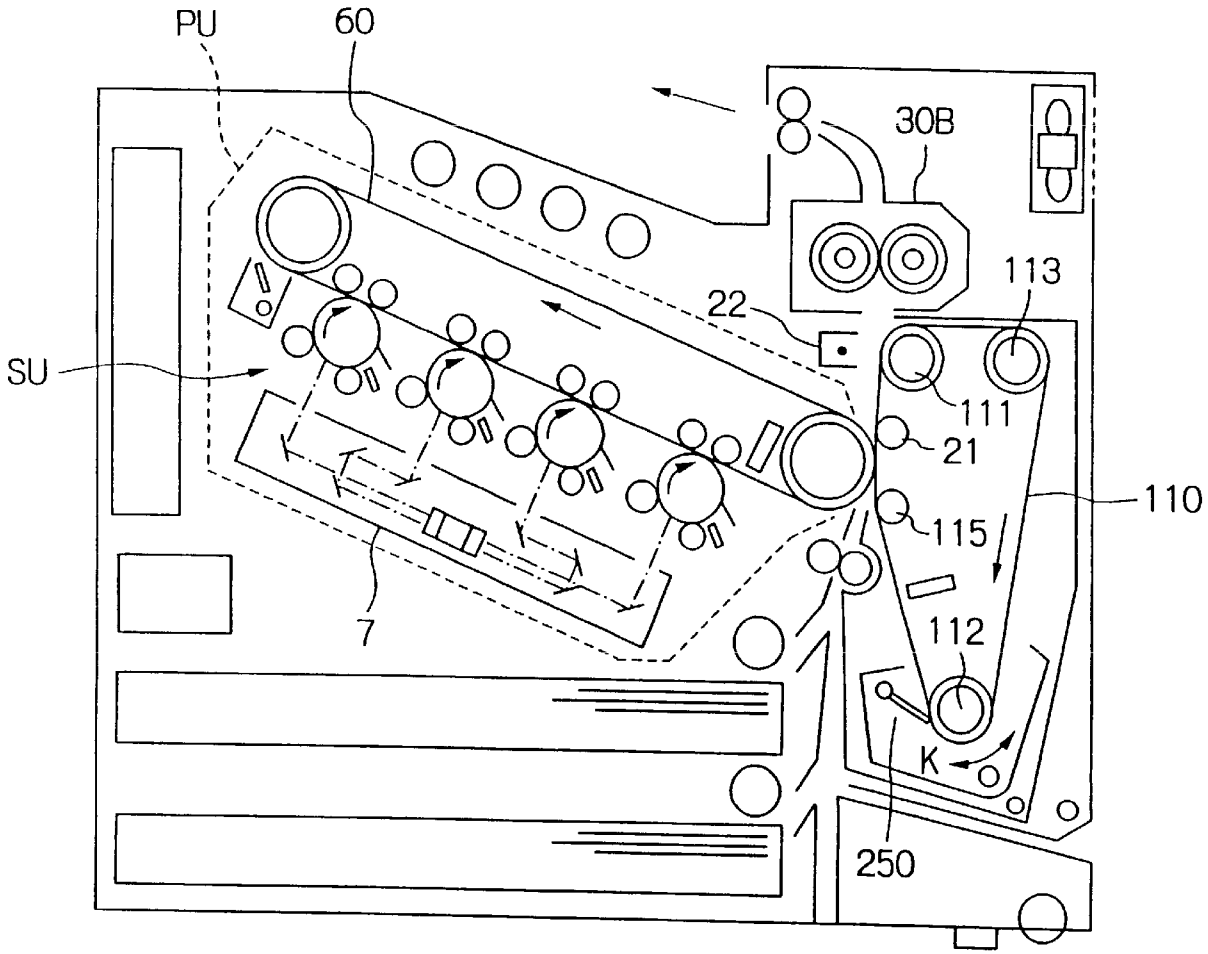
FIG. 14 is a view showing a fourth embodiment of the present invention.
Figure 15:
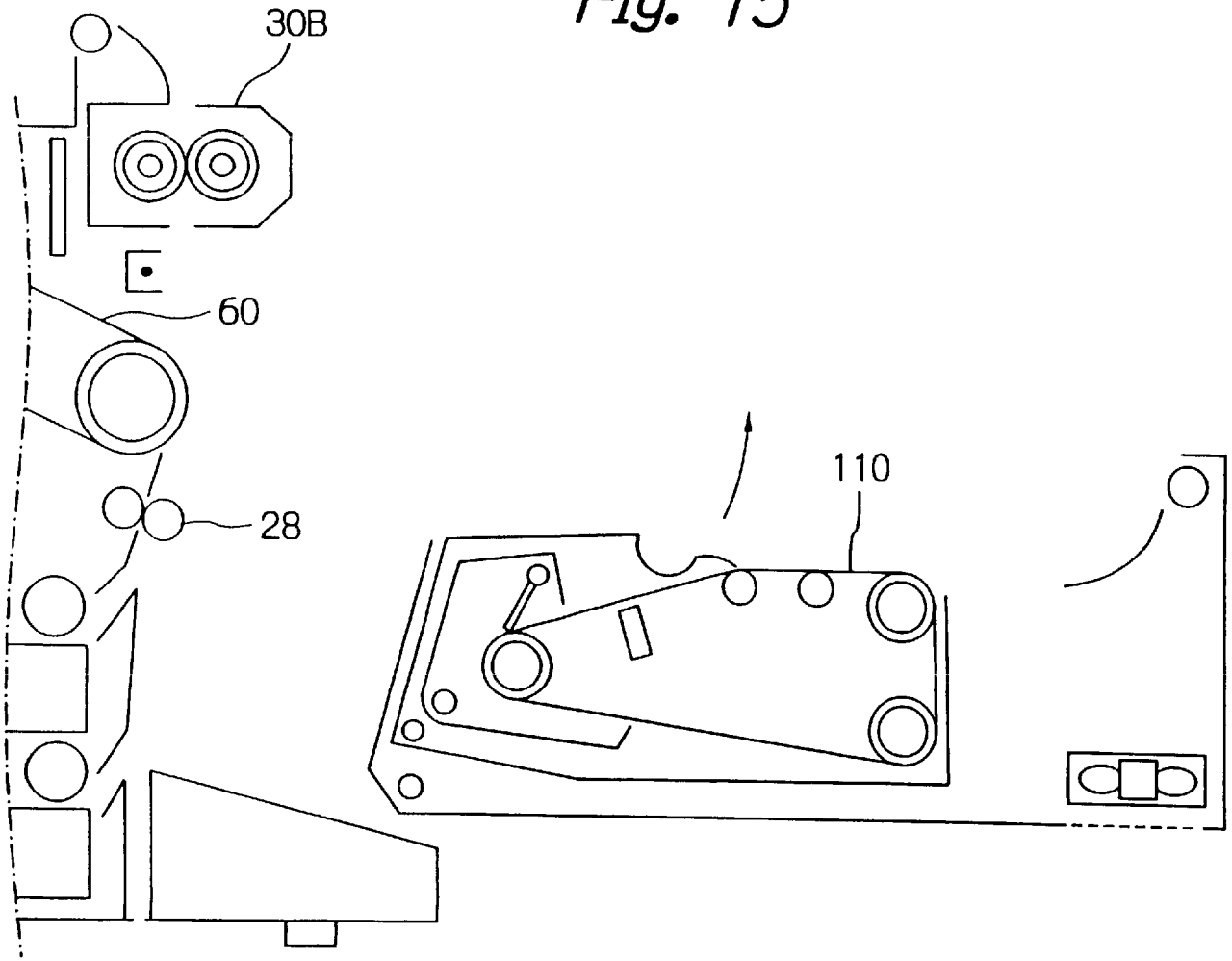
FIG. 15 is a fragmentary section showing the fourth embodiment with a cover loaded with a second image carrier being held in an open position.

FIG. 14 shows another specific printer configuration similar to the configuration of FIG. 13 except for the fixing device 30B and cleaning means 250 assigned to the belt 110. Specifically, in FIG. 14, the fixing device 30B is positioned outside of the loop of the belt 110. The cleaning means 250 is different in configuration and position from the cleaning means 250 of FIG. 11. As shown in FIG. 15, the fixing device 30B is mounted on the printer body and remains on the printer body when the cover is opened. As for the rest of the configuration, the printer of FIG. 14 is identical with the printer of FIG. 11.

In the printers shown in FIGS. 11 and 14, assume that the maximum image size available with the belt 110 is the A3 profile size that is 420 mm long in the direction of movement of the belt 110. Then, the belt 110 is reversed when the image size is the A4 landscape size (210 mm) or below or caused to complete one forward turn when it is larger than the A4 landscape size. This successfully prevents productivity from being lowered when the image size is large and enhances productivity when it is small.

Figure 16:
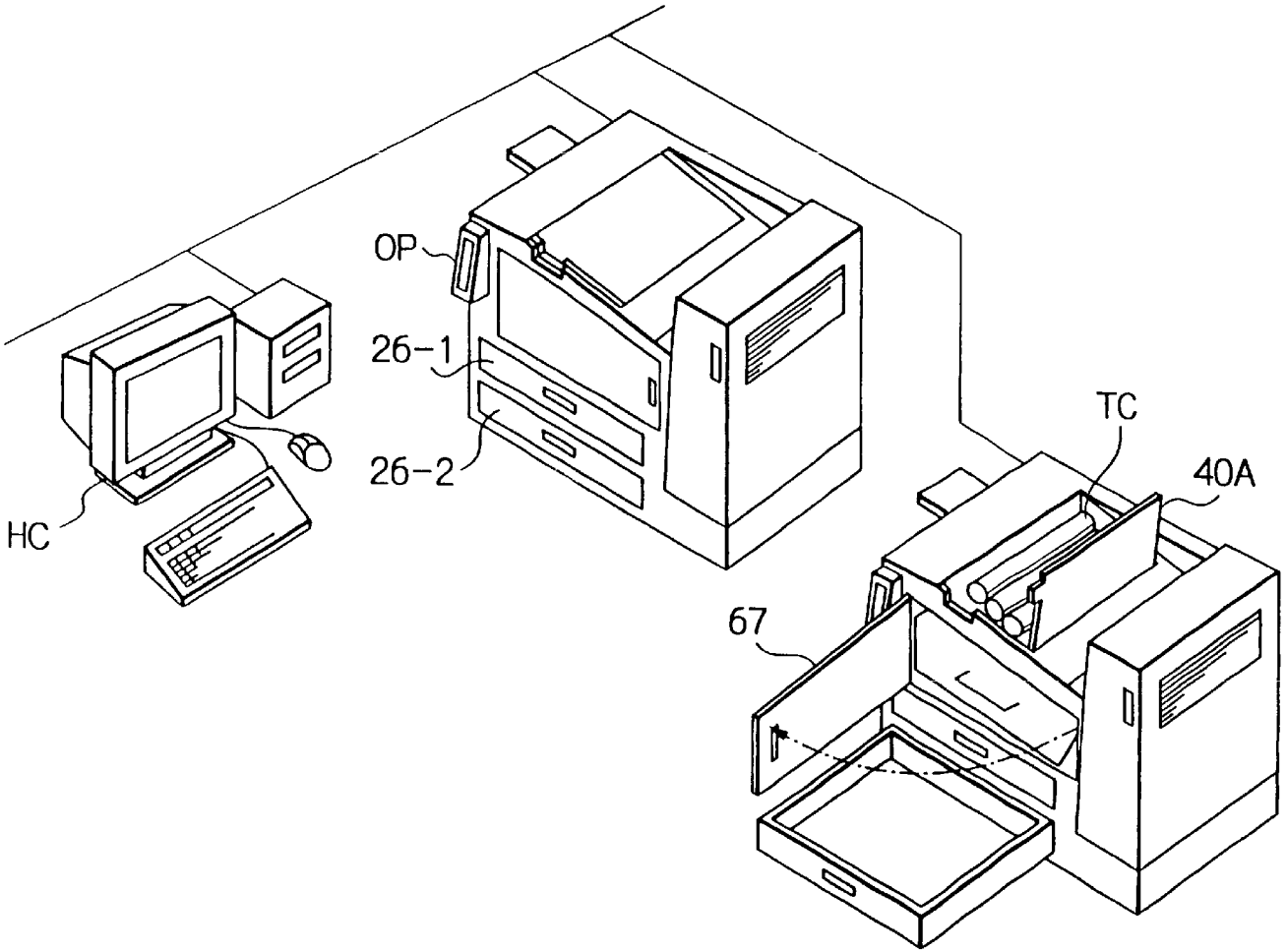
FIG 16 is an isometric view showing a plurality of image forming apparatuses each having the configuration of FIG. 11 or 14 and connected to a network.

FIG. 16 shows two printers each having the configuration of FIG. 11 or 14 and connected to a host computer HC by a network. The network may be implemented by radio in place of cables. As shown, an operation panel OP is mounted on each printer.

As shown in FIG. 11 or 14, a cover 40A covering the toner storing section TS forms the bottom of the stacker portion 40. The cover 40A is openable about a shaft 40B. As shown in FIG. 16, by opening the cover 40A, the operator can easily deal with the toner cartridges TC. The shaft 40B adjoins the outlet roller pair 32. Therefore, even when the operator opens the cover 40A with a stack of prints existing on the stacker portion 40, the prints are prevented from dropping and having the order of page disturbed.

Further, as shown in FIG. 16, a door 67 is mounted on the front of the printer body is openable about its left edge. By opening the door 67, the operator can easily perform maintenance of the image forming section PU. More specifically, the image forming section PU is constructed such that the belt 60, four image forming units SU and structural elements around them can be pulled out toward the operator along guide rails, not shown, with the scanning unit 7 remaining on the printer body 7. The operator can then pick up the belt 60 and individual image forming units SU, as desired. Because the door 67 is connected to the printer body via a vertical hinge, it allows the operator to easily see structural elements below the door 67 even when it is opened. In addition, the door 67 facilitates the replenishment of sheets to the sheet trays 26-1 and 26-2 even when opened.

A seal, not shown, prevents the structural elements of the scanning unit 7 from being contamination by the toner. A controller, not shown, deal with a mirror image and a regular image to be selectively formed by the scanning unit 7.

The sheet trays 26-1 and 26-2 each can be pulled out toward the front of the printer body, so that the operator can easily replenish sheets. The printer shown at the right-hand side in FIG. 16 is shown with its door 67 opened and its sheet tray 26-2 pulled out.

Figure 17:
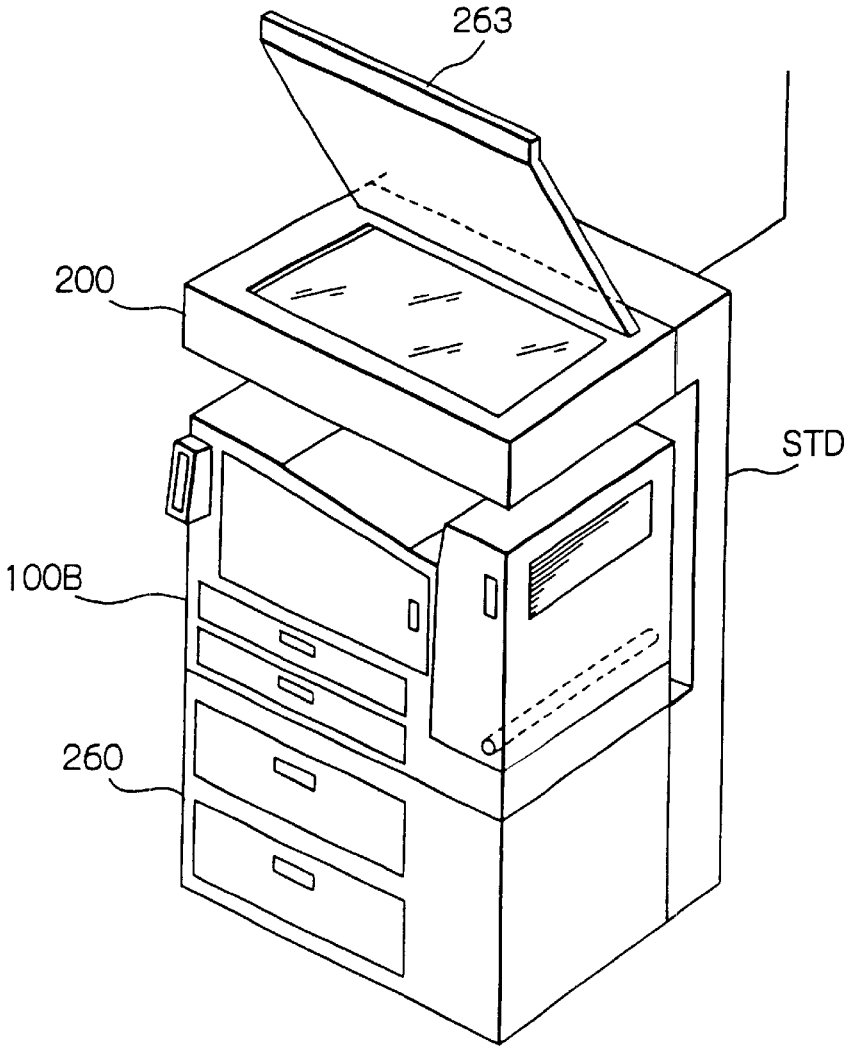
FIG. 17 is a perspective view showing the third or the fourth embodiment additionally including a sheet feeder and a scanner as options.

FIG. 17 shows a copier 100B identical with the printer of FIG. 11 or 14 except that a sheet feeder 260 and a scanner 200 are additionally mounted as options. As shown, the copier 100B includes a cover plate 263 for pressing a document and a stand STD supporting the scanner 200. An ADF (Automatic Document Feeder) may be mounted to the scanner 200, if desired.

In the embodiments shown and described, whether or not to move the belt in the reverse direction is determined by using the sheet size of A4 as a reference. Alternatively, this decision may be made by using the length, forward speed and reverse speed of the belt or any other suitable factors of the printer as a reference. Also, the mechanism for moving the belt or second image carrier into and out of contact with the drum or first image carrier shown and described is only illustrative. This is also true with the mechanism for correcting the offset of the belt. Of course, the offset correcting mechanism is applicable to the belt or second image carrier 110 shown in FIG. 11 or 14.

In the embodiment of FIG. 11 or 14, a toner image carried on the belt 110 may be inverted in polarity. The first image carrier may be implemented as a belt in place of a drum. Further, the polarity of the drum, the polarity of toner, the polarity of bias voltages and the polarity of the polarity inverting voltage shown and described are only illustrative and may be reversed. Moreover, the present invention is practicable even with analog exposure in place of the scanning scheme using a semiconductor laser or an LED array. Of course, the present invention is applicable not only to a printer but also to any other image forming apparatus, e.g., a copier or a facsimile apparatus.

In summary, it will be seen that the present invention provides an image forming method and an image forming apparatus having various unprecedented advantages, as enumerated below.

(1) After a toner image has been transferred from a first image carrier to a second image carrier, the second image carrier is moved in the reverse direction to a preselected position. It is therefore possible to print, in a duplex print mode, an image on the first side of a sheet and then immediately print an image on the second side of the same sheet. This enhances productivity in the duplex print mode.

(2) During the reverse movement of the second image carrier, the polarity of an image carried on the second image carrier is inverted. Images can therefore be transferred to both sides of a sheet at the same time. In addition, the first image carrier is free from the electrical influence of polarity inversion.

(3) The second image carrier is implemented as an endless belt that is easy to move in the reverse direction. In addition, the endless belt needs a minimum of space and is simple in configuration.

(4) The second image carrier is moved in the reverse direction at a higher speed than in the forward direction. This reduces an image forming time and thereby enhances productivity.

(5) The second image carrier is driven by drive means independent of drive means assigned to the first image carrier. The second image carrier can therefore easily moved in the forward and reverse directions and can have its speed easily switched. This is particularly true when the drive means assigned to the second image carrier is implemented by a stepping motor.

(6) The second image carrier is movable into and out of contact with the first image carrier, so that the first and second image carriers are deteriorated little.

(7) The polarity of an image carried on the second image carrier is inverted during the forward movement of the image carrier. It is therefore not necessary to take account of the relative position of polarity inverting means and the second image carrier. This frees the apparatus from sophisticated configuration.

(8) The position of a polarity inverting device relative to the second image carrier does not change. The polarity of an image can therefore be inverted even when the second image carrier is released from the first image carrier and then moved in the reverse direction.

(9) The polarity inverting device is positioned downstream of a position where an image is to be transferred from the first image carrier to the second image carrier in the direction of forward movement of the second image carrier. This minimizes the distance of movement of the second image carrier and thereby enhances productivity.

(10) Mark sensing means MS senses a mark MA provided on the second image carrier as shown in FIG 18. The movement of the second image carrier is controlled on the basis of the position of the mark sensed and can therefore be accurately controlled to enhance image quality.

(11) When the size of an image to be transferred to the second image carrier or belt is larger than a preselected size, the second image carrier is inhibited from being moved in the reverse direction. This prevents productivity from falling when the image size is large.

(12) An anti-offset mechanism obviates the offset of the belt and thereby protects the belt from damage while insuring desirable image quality.

(13) Images are fixed on a sheet with the second image carrier and sheet being held in register. This obviates the dislocation of images ascribable to fixation and thereby insures high image quality.

Various modifications will become possible for those skilled in the art after receiving the teachings of the present disclosure without departing from the scope thereof.

What is claimed is:

1. An image forming apparatus operable in a duplex print mode for printing images on both sides of a recording medium, said image forming apparatus comprising:

a first image carrier configured to carry a toner image;

a second image carrier positioned to receive the toner image from the first image carrier;

a controller configured to control said first and second image carriers such that during the duplex print mode, after a first toner image is transferred from said first image carrier to said second image carrier, said second image carrier is moved in a reverse direction to a preselected position; and a fixing device positioned to fix at least the first toner image transferred onto the recording medium while said second image carrier and recording medium are lying on each other, wherein said second image carrier transfers the first toner image to one side of the recording medium and said first image carrier transfers a second toner image to the other side of said recording medium during the duplex print mode.

2. The apparatus as claimed in claim 1, wherein said second image carrier comprises an endless belt.

3. The apparatus as claimed in claim 2, wherein the endless belt is moved in the reverse direction to thereby bring said second image carrier to the preselected position.

4. The apparatus as claimed in claim 2, further comprising inhibiting means for inhibiting said second image carrier from being moved in the reverse direction when the toner image to be transferred to said second image carrier has a size larger than a size.

5. The apparatus as claimed in claim 2, further comprising a mechanism for preventing the endless belt from becoming offset.

6. The apparatus as claimed in claim 1, wherein said second image carrier is moved in the reverse direction at a higher speed than in a forward direction.

7. The apparatus as claimed in claim 1, wherein the controller comprises drive means for driving said second image carrier independently of drive means assigned to said first image carrier.

8. The apparatus as claimed in claim 7, wherein said drive means assigned to said second image carrier comprises a stepping motor.

9. The apparatus as claimed in claim 8, wherein a movement of said second image carrier is controlled on the basis of a number of steps of the stepping motor.

10. The apparatus as claimed in claim 1, wherein said second image carrier is selectively movable into or out of contact with said first image carrier.

11. The apparatus as claimed in claim 10, wherein when said second image carrier is to be moved in the reverse direction, said second image carrier is released from said first image carrier.

12. The apparatus as claimed in claim 1, wherein the controller comprises a mark provided on a surface of said second image carrier.

13. The apparatus as claimed in claim 12, wherein the controller comprises mark sensing means for sensing the mark, wherein said second image carrier is controlled on the basis of a position of said mark sensed.

14. An image forming apparatus operable in a duplex print mode for printing images on both sides of a recording medium, said image forming apparatus comprising:

a first image carrier configured to carry a toner image;

a second image carrier positioned to receive the toner image from the first image carrier;

first image transferring means for transferring the toner image from said first image carrier to one of said second image carrier and one side of the recording medium; and second image transferring means for transferring the toner image carried on said second image carrier to the other side of the recording medium;

a controller configured to control said first and second image carriers such that during the duplex print mode, after a first toner image is transferred from said first image carrier to said second image carrier, said second image carrier is moved in a reverse direction to a preselected position, wherein during the duplex print mode, the first image transferring means transfers the first toner image from said second image carrier to one side of the recording medium, the second image transferring means transfers a second toner image from said first image carrier to the other side of said recording medium, and the first and second image transferring means prevent said second image carrier from being moved in the reverse direction when a toner image to be transferred to said second image carrier has a size larger than a preselected size.

15. The apparatus as claimed in claim 14, wherein said second image carrier comprises an endless belt.

16. The apparatus as claimed in claim 15, wherein the endless belt is moved in the reverse direction to thereby bring said second image carrier to the preselected position.

17. The apparatus as claimed in claim 15, further comprising a mechanism for preventing the endless belt from becoming offset.

18. The apparatus as claimed in claim 14, wherein said second image carrier is moved in the reverse direction at a higher speed than in a forward direction.

19. The apparatus as claimed in claim 18, wherein controller comprises drive means for driving said second image carrier independently of drive means assigned to said first image carrier.

20. The apparatus as claimed in claim 19, wherein said drive means assigned to said second image carrier comprises a stepping motor.

21. The apparatus as claimed in claim 20, wherein said second image carrier is controlled on the basis of a number of steps of the stepping motor.

22. The apparatus as claimed in claim 14, wherein said second image carrier is selectively movable into or out of contact with said first image carrier.

23. The apparatus as claimed in claim 22, wherein when said second image carrier is to be moved in the reverse direction, said second image carrier is released from said first image carrier.

24. The apparatus as claimed in claim 14, wherein the controller comprises a mark provided on a surface of said second image carrier.

25. The apparatus as claimed in claim 24, wherein the controller comprises mark sensing means for sensing the mark, wherein said second image carrier is controlled on the basis of a position of said mark sensed.

26. The apparatus as claimed in claim 14, further comprising a fixing device configured to fix at least the first toner image transferred to the recording medium while said second image carrier and said recording medium are lying on each other.

27. An image forming apparatus operable in a duplex print mode for printing images on both sides of a recording medium, said image forming apparatus comprising:

a first image carrier configured to carry a toner image;

a second image carrier positioned to receive the toner image from the first image carrier;

a polarity inverting device configured to invert a polarity of charge deposited on the toner image carried on said second image carrier;

a controller configured to control said first and second image carriers such that during the duplex print mode, after a first toner image is transferred from said first image carrier to said second image carrier, said second image carrier is moved in a reverse direction to a preselected position; and a fixing device positioned to fix at least the first toner image transferred onto the recording medium while said second image carrier and recording medium are lying on each other, wherein said second image carrier transfers the first toner image to one side of the recording medium and said first image carrier transfers a second toner image to the other side of said recording medium during the duplex print mode.

28. The apparatus as claimed in claim 27, wherein said second image carrier comprises an endless belt.

29. The apparatus as claimed in claim 28, wherein the endless belt is moved in the reverse direction to thereby bring said second image carrier to the preselected position.

30. The apparatus as claimed in claim 28, further comprising inhibiting means for inhibiting said second image carrier from being moved in the reverse direction when the toner image to be transferred to said second image carrier has a size larger than a preselected size.

31. The apparatus as claimed in claim 28, further comprising a mechanism for preventing the endless belt from becoming offset.

32. The apparatus as claimed in claim 27, wherein said second image carrier is moved in the reverse direction at a higher speed than in a forward direction.

33. The apparatus as claimed in claim 27, wherein the controller comprises drive means for driving said second image carrier independently of drive means assigned to said first image carrier.

34. The apparatus as claimed in claim 33, wherein said drive means assigned to said second image carrier comprises a stepping motor.

35. The apparatus as claimed in claim 34, wherein a movement of said second image carrier is controlled on the basis of a number of steps of the stepping motor.

36. The apparatus as claimed in claim 27, wherein said second image carrier is selectively movable into or out of contact with said first image carrier.

37. The apparatus as claimed in claim 36, wherein when said second image carrier is to be moved in the reverse direction, said second image carrier is released from said first image carrier.

38. The apparatus as claimed in claim 27, wherein said polarity inverting device inverts the polarity during a forward movement of said second image carrier.

39. The apparatus as claimed in claim 27, wherein said polarity inverting device inverts the polarity during a reverse movement of said second image carrier.

40. The apparatus as claimed in claim 39, wherein said second image carrier is selectively movable into or out of contact with said first image carrier, and a position of said polarity inverting device relative to said second image carrier does not vary.

41. The apparatus as claimed in claim 27, wherein said polarity inverting device is positioned downstream of a position where the toner image is to be transferred from said first image carrier to said second image carrier in a direction of forward movement of said second image carrier.

42. The apparatus as claimed in claim 27, wherein the controller comprises a mark provided on a surface of said second image carrier.

43. The apparatus as claimed in claim 42, wherein the controller comprises mark sensing means for sensing the mark, wherein said second image carrier is controlled on the basis of a position of said mark sensed.

44. An image forming apparatus operable in a duplex print mode for printing images on both sides of a recording medium, said image forming apparatus comprising:

a first image carrier configured to carry a toner image;

a second image carrier positioned to received the toner image from the first image carrier;

image transferring means for transferring the toner image from said first image carrier to one of said second image carrier and one side of the recording medium and transferring the toner image from said second image carrier to the other side of said recording medium;

a controller configured to control the first and second image carriers such that during the duplex print mode, after a first toner image is transferred from said first image carrier to said second image carrier, said second image carrier is moved in a reverse direction to a preselected position; and a polarity inverting device configured to invert a polarity of charge deposited on the toner image carried on said image carrier, wherein:

said second image carrier transfers the first toner image to one side of the recording medium, and said first image carrier transfers a second toner image to the other side of said recording medium during the duplex print mode; and the image transferring means and polarity inverting device inhibit said second image carrier from being moved in the reverse direction when the toner image to be transferred to said second image carrier has a size larger than a preselected size.

45. The apparatus as claimed in claim 44, wherein said second image carrier comprises an endless belt.

46. The apparatus as claimed in claim 45, wherein the endless belt is moved in the reverse direction to thereby bring said second image carrier to the preselected position.

47. The apparatus as claimed in claim 45, further comprising a mechanism for preventing the endless belt from becoming offset.

48. The apparatus as claimed in claim 44, wherein said second image carrier is moved in the reverse direction at a higher speed than in a forward direction.

49. The apparatus as claimed in claim 44, wherein the controller comprises drive means for driving said second image carrier independently of drive means assigned to said first image carrier.

50. The apparatus as claimed in claim 49, wherein said drive means assigned to said second image carrier comprises a stepping motor.

51. The apparatus as claimed in claim 50, wherein a movement of said second image carrier is controlled on the basis of a number of steps of the stepping motor.

52. The apparatus as claimed in claim 44, wherein said second image carrier is selectively movable into or out of contact with said first image carrier.

53. The apparatus as claimed in claim 52, wherein when said second image carrier is to be moved in the reverse direction, said second image carrier is released from said first image carrier.

54. The apparatus as claimed in claim 44, wherein said polarity inverting device inverts the polarity during a forward movement of said second image carrier.

55. The apparatus as claimed in claim 44, wherein said polarity inverting device inverts the polarity during a reverse movement of said second image carrier.

56. The apparatus as claimed in claim 55, wherein said second image carrier is selectively movable into or out of contact with said first image carrier, and a position of said polarity inverting device relative to said second image carrier does not vary.

57. The apparatus as claimed in claim 44, wherein said polarity inverting device is positioned downstream of a position where the toner image is to be transferred from said first image carrier to said second image carrier in a direction of forward movement of said second image carrier.

58. The apparatus as claimed in claim 44, wherein the controller comprises a mark provided on a surface of said second image carrier.

59. The apparatus as claimed in claim 58, wherein the controller comprises mark sensing means for sensing the mark, wherein said second image carrier is controlled on the basis of a position of said mark sensed.

60. The apparatus as claimed in claim 44, further comprising a fixing device configured to fix at least the first toner image transferred to the recording medium while said second image carrier and said recording medium are lying on each other.

61. An image forming method for transferring, in a duplex print mode, a toner image, the image forming method comprising:

transferring a first toner image from a first image carrier to a second image carrier;

moving said second image carrier in a reverse direction to a preselected position after said first toner image is transferred from said first image carrier to said second image carrier;

transferring said first toner image from said second image carrier to one side of a recording medium;

transferring a second toner image from said first image carrier to the other side of said recording medium; and fixing at least the first toner image transferred to the recording medium while said second image carrier and said recording medium are lying on each other.

62. An image forming method for transferring, in a duplex mode, a toner image, the image forming method comprising:

transferring a first toner image from a first image carrier to a second image carrier with first image transferring means;

moving said second image carrier in a reverse direction to a preselected position after said first toner image is transferred from said first image carrier to said second image carrier;

transferring a second toner image from said first image carrier to one side of said recording medium with said first image transferring means;

transferring said first toner image carried on said second image carrier to the other side of said recording medium with second image transferring means wherein said moving is inhibited when said first toner image to be transferred to said second image carrier has a size larger than a preselected size.

63. An image forming method for transferring, in a duplex print mode, a toner image, the image forming method comprising:

transferring a first toner image from a first image carrier to a second image carrier;

moving said second image carrier in a reverse direction to a preselected position after said first toner image is transferred from said first image carrier to said second image carrier;

inverting a polarity of charge deposited on the first toner image carried on said second image carrier;

transferring said first toner image from said second image carrier to one side of a recording medium; and transferring a second toner image from said first image carrier to the other side of said recording medium;

fixing at least the first toner image transferred to the recording medium while said second image carrier and said recording medium are lying on each other.

64. An image forming method for transferring, in a duplex print mode, a toner image, the image forming method comprising:

transferring a first toner image from a first image carrier to a second image carrier;

moving said second image carrier in a reverse direction to a preselected position after said first toner image is transferred from said first image carrier to said second image carrier;

inverting a polarity of charge deposited on the first toner image carried on said second image carrier;

transferring said first toner image carried on said second image carrier to one side of said recording medium with a single image transferring means;

transferring a second toner image from said first image carrier to the other side of said recording medium, wherein said moving is inhibited when said first toner image to be transferred to said second image carrier has a size larger than a preselected size.

65. An image forming apparatus operable in a duplex print mode for printing images on both sides of a recording medium, said image forming apparatus comprising:

a first image carrier configured to carry a toner image;

a second image carrier positioned to receive the toner image from the first image carrier;

controlling means for controlling said first and second image carriers such that during the duplex print mode, after a first toner image is transferred from said first image carrier to said second image carrier, said second image carrier is moved in a reverse direction to a preselected position; and fixing means for fixing at least the first toner image transferred onto the recording medium while said second image carrier and recording medium are lying on each other, wherein said second image carrier transfers the first toner image to one side of the recording medium and said first image carrier transfers a second toner image to the other side of said recording medium during the duplex print mode.

66. An image forming apparatus operable in a duplex print mode for printing images on both sides of a recording medium, said image forming apparatus comprising:

a first image carrier configured to carry a toner image;

a second image carrier positioned to received the toner image from the first image carrier;

controlling means for controlling the first and second image carriers such that during the duplex print mode, after said toner image is transferred from said first image carrier to said second image carrier, said second image carrier is moved in a reverse direction to a preselected position; and inhibiting means for inhibiting said second image carrier from being moved in the reverse direction when the toner image to be transferred to said second image carrier has a size larger than a preselected size, wherein said second image carrier transfers a first toner image to one side of the recording medium, and said first image carrier transfers a second toner image to the other side of said recording medium during the duplex print mode.

* * * * *